US008014987B2

(12) United States Patent
Pabon et al.

(10) Patent No.: US 8,014,987 B2
(45) Date of Patent: Sep. 6, 2011

(54) MODELING THE TRANSIENT BEHAVIOR OF BHA/DRILL STRING WHILE DRILLING

(75) Inventors: Jahir Pabon, Wellesley, MA (US); Nathan Wicks, Somerville, MA (US); Yong Chang, Missouri City, TX (US); Clinton Chapman, Missouri City, TX (US); Vivek Singh, Houston, TX (US)

(73) Assignee: Schlumberger Technology Corp., Houston, TX (US)

( * ) Notice: Subject to any disclaimer, the term of this patent is extended or adjusted under 35 U.S.C. 154(b) by 796 days.

(21) Appl. No.: 12/061,252

(22) Filed: Apr. 2, 2008

(65) Prior Publication Data

US 2008/0255817 A1 Oct. 16, 2008

Related U.S. Application Data

(60) Provisional application No. 60/923,382, filed on Apr. 13, 2007.

(51) Int. Cl.
*G06G 7/48* (2006.01)

(52) U.S. Cl. ..... 703/10

(58) Field of Classification Search ..... 703/10
See application file for complete search history.

(56) References Cited

U.S. PATENT DOCUMENTS

| | | | | |
|---|---|---|---|---|
| 5,139,094 | A | 8/1992 | Prevedel et al. | |
| 5,517,464 | A | 5/1996 | Lerner et al. | |
| 5,680,906 | A | 10/1997 | Andrieux et al. | |
| 5,899,958 | A | 5/1999 | Dowell et al. | |
| 5,992,519 | A | 11/1999 | Ramakrishnan et al. | |
| 6,266,619 | B1 | 7/2001 | Thomas et al. | |
| 6,313,837 | B1 | 11/2001 | Assa et al. | |
| 6,363,780 | B1 | 4/2002 | Rey-Fabret et al. | |
| 6,785,641 | B1 | 8/2004 | Huang | |
| 6,980,940 | B1 | 12/2005 | Gurpinar et al. | |
| 7,003,439 | B2 | 2/2006 | Aldred et al. | |
| 7,020,597 | B2 | 3/2006 | Oliver et al. | |
| 7,054,750 | B2 | 5/2006 | Rodney et al. | |
| 7,079,952 | B2 | 7/2006 | Thomas et al. | |
| 7,251,590 | B2 * | 7/2007 | Huang et al. | 703/2 |
| 2003/0132934 | A1 | 7/2003 | Fremming | |
| 2003/0216897 | A1 | 11/2003 | Endres et al. | |
| 2004/0220846 | A1 | 11/2004 | Cullick et al. | |
| 2005/0133272 | A1 * | 6/2005 | Huang et al. | 175/327 |
| 2005/0149307 | A1 | 7/2005 | Gurpinar et al. | |
| 2005/0189142 | A1 | 9/2005 | Garcia et al. | |

(Continued)

FOREIGN PATENT DOCUMENTS

GB 2392931 A 3/2004

(Continued)

OTHER PUBLICATIONS

Written opinion for PCT US 2008 059803, Oct. 13, 2009, pp. 1-7.*
Asvaduro et al., Finite-difference modeling of viscoelastic materials with quality factors of arbitrary magnitude, Geophysics, vol. 69, No. 3 (May-Jun. 2004); p. 817-824.*

(Continued)

*Primary Examiner* — Hugh Jones

(57) ABSTRACT

A method, system and computer program product for performing a drilling operation for an oil field, the oil field having a subterranean formation with geological structures and reservoirs therein. The method involves creating a finite-difference model to simulate behavior of a drilling assembly used to drill a wellbore in the drilling operation, performing a simulation of the drilling operation using the finite-difference model, analyzing a result of the simulation, and selectively modifying the drilling operation based on the analysis.

30 Claims, 17 Drawing Sheets

U.S. PATENT DOCUMENTS

| | | | | |
|---|---|---|---|---|
| 2005/0209836 | A1 | 9/2005 | Klumpen et al. | |
| 2005/0209886 | A1 | 9/2005 | Corkern | |
| 2005/0211468 | A1 | 9/2005 | Veeningen et al. | |
| 2005/0228905 | A1 | 10/2005 | Veeningen et al. | |
| 2005/0236184 | A1 | 10/2005 | Veeningen et al. | |
| 2006/0195307 | A1 * | 8/2006 | Huang et al. | 703/7 |
| 2006/0197759 | A1 | 9/2006 | Fremming | |

FOREIGN PATENT DOCUMENTS

| | | | |
|---|---|---|---|
| GB | 2411669 | A | 9/2005 |
| WO | 99/64896 | A1 | 12/1999 |
| WO | 9964896 | A1 | 12/1999 |
| WO | 2004/049216 | A1 | 6/2004 |
| WO | 2004049216 | A1 | 6/2004 |

OTHER PUBLICATIONS

Richard et al., "Influence of bit-rock interaction on stick-slip vibrations of PDC bits", 2002, Society of Petroleum Engineers Inc., SPE Annual Technical Conference and Exhibition, San Antonio, Texas, pp. 1-12.

Schmalhorst et al., "Dynamic Modeling Software", AADE 2003 National Technology Conference, Houston Texas, Apr. 2003, pp. 1-9.

Aslaksen et al., "Integrated FEA Modeling Offers System Approach to Drillstring Optimization", IADC/SPE Drilling Conference, Miami Florida, Feb. 2006, pp. 1-16.

Jogi et al., "Visualization of BHA Dynamics Improves Understanding of Downhole Drilling Conditions, Speeds Up Learning Curve", IADC/SPE Drilling Conference, Miami Florida, Feb. 2006, pp. 1-10.

* cited by examiner

MODELING THE TRANSIENT BEHAVIOR OF BHA/DRILL STRING WHILE DRILLING

RELATED APPLICATIONS

This application claims priority based on U.S. Provisional Patent Application Ser. No. 60/923,382, filed on Apr. 13, 2007.

BACKGROUND OF THE INVENTION

1. Field of the Invention

This invention relates to methods and systems for use in performing oilfield operations relating to subterranean formations having reservoirs therein. In particular, the invention provides methods, apparatuses and systems for more effectively and efficiently performing a drilling operation involving creating a model that simulates behavior of a drilling assembly used to drill a wellbore in the drilling operation, performing a simulation of the drilling operation using the model, and selectively modifying the drilling operation or drilling assembly based on analysis of the simulation.

2. Background of the Invention

Oilfield operations, such as surveying, drilling, wireline testing, completions, and production, are typically performed to locate and gather valuable downhole fluids. As shown in FIG. 1A, surveys are often performed using acquisition methodologies, such as seismic scanners to generate maps of underground structures. These structures are often analyzed to determine the presence of subterranean assets, such as valuable fluids or minerals. This information is used to assess the underground structures and locate the formations containing the desired subterranean assets. Data collected from the acquisition methodologies may be evaluated and analyzed to determine whether such valuable items are present and if they are reasonably accessible.

As shown in FIGS. 1B-1D, one or more wellsites may be positioned along the underground structures to gather valuable fluids from the subterranean reservoirs. The wellsites are provided with tools capable of locating and removing hydrocarbons from the subterranean reservoirs. As shown in FIG. 1B, drilling tools are typically advanced from the oil rigs and into the earth along a given path to locate the valuable downhole fluids. During a drilling operation, the drilling tool may perform downhole measurements to investigate downhole conditions. In some cases, as shown in FIG. 1C, the drilling tool is removed and a wireline tool is deployed into the wellbore to perform additional downhole testing.

After the drilling operation is complete, the well may then be prepared for production. As shown in FIG. 1D, wellbore completion equipment is deployed into the wellbore to complete the well in preparation for the production of fluid therethrough. Fluid is then drawn from downhole reservoirs into the wellbore and flows to the surface. Production facilities are positioned at surface locations to collect the hydrocarbons from the wellsite(s). Fluid drawn from the subterranean reservoir(s) passes to the production facilities via transport mechanisms, such as tubing. Various equipment may be positioned about the oilfield to monitor oilfield parameters and/or to manipulate the oilfield operations.

During oilfield operations, data is typically collected for analysis and/or monitoring of the oilfield operations. Such data may include, for example, subterranean formation, equipment, historical, and/or other data. Data concerning the subterranean formation is collected using a variety of sources. Such formation data may be static or dynamic. Static data relates to formation structure and geological stratigraphy that defines the geological structure of the subterranean formation. Dynamic data relates to fluids flowing through the geologic structures of the subterranean formation. Such static and/or dynamic data may be collected to learn more about the formations and the valuable assets contained therein.

Sources used to collect static data may be seismic tools, such as a seismic truck that sends compression waves into the earth as shown in FIG. 1A. These waves are measured to characterize changes in the density of the geological structure at different depths. This information may be used to generate basic structural maps of the subterranean formation. Other static measurements may be gathered using core sampling and well logging techniques. Core samples are used to take physical specimens of the formation at various depths as shown in FIG. 1B. Well logging involves deployment of a downhole tool into the wellbore to collect various downhole measurements, such as density, resistivity, etc. at various depths. Such well logging may be performed using, for example, the drilling tool of FIG. 1B and/or the wireline tool of FIG. 1C. Once the well is formed and completed, fluid flows to the surface using production tubing as shown in FIG. 1D. As fluid passes to the surface, various dynamic measurements, such as fluid flow rates, pressure, and composition may be monitored. These parameters may be used to determine various characteristics of the subterranean formation.

Sensors may be positioned about the oilfield to collect data relating to various oilfield operations. For example, sensors in the wellbore may monitor fluid composition, sensors located along the flow path may monitor flow rates and sensors at the processing facility may monitor fluids collected. Other sensors may be provided to monitor downhole, surface, equipment or other conditions. The monitored data is often used to make decisions at various locations of the oilfield at various times. Data collected by these sensors may be further analyzed and processed. Data may be collected and used for current or future operations. When used for future operations at the same or other locations, such data may sometimes be referred to as historical data.

The processed data may be used to predict downhole conditions, and make decisions concerning oilfield operations. Such decisions may involve well planning, well targeting, well completions, operating levels, production rates and other configurations. Often this information is used to determine when to drill new wells, re-complete existing wells or alter wellbore production.

Data from one or more wellbores may be analyzed to plan or predict various outcomes at a given wellbore. In some cases, the data from neighboring wellbores or wellbores with similar conditions or equipment is used to predict how a well will perform. There are usually a large number of variables and large quantities of data to consider in analyzing wellbore operations. It is, therefore, often useful to model the behavior of the oilfield operation to determine the desired course of action. During the ongoing operations, the operating conditions may need adjustment as conditions change and new information is received.

Techniques have been developed to model the behavior of geological structures, downhole reservoirs, wellbores, surface facilities as well as other portions of the oilfield operation. Examples of modeling techniques are shown in U.S. Pat. No. 5,992,519, WO2004049216, WO 1999/064896, U.S. Pat. No. 6,313,837, US2003/0216897, US2003/0132934, US20050149307 and US2006/0197759. Typically, existing modeling techniques have been used to analyze only specific portions of the oilfield operation. More recently, attempts have been made to use more than one model in analyzing certain oilfield operations. See, for example, U.S. Pat. No. 6,980,940, WO04049216, 20040220846 and Ser. No. 10/586,283.

Techniques have also been developed to predict and/or plan certain oilfield operations, such as drilling operations. Examples of techniques for generating drilling plans are provided in U.S. Patent/Application Nos. 20050236184, 20050211468, 20050228905, 20050209886, and 20050209836. Some drilling techniques involve controlling the drilling operation. Examples of such drilling techniques are shown in Patent/Application Nos. GB2392931 and GB2411669. Other drilling techniques seek to provide real-time drilling operations. Examples of techniques purporting to provide real time drilling are described in U.S. Pat. Nos. 7,079,952, 6,266,619, 5,899,958, 5,139,094, 7,003,439 and 5,680,906.

Development of an effective drilling plan requires a clear understanding of how a drilling assembly might be expected to behave during a drilling operation. To provide such an understanding, it is known to use modeling technology to simulate the behavior of a particular drilling assembly, for example, the BHA (Bottom Hole Assembly) or an entire drill string, during a particular drilling operation, before a drilling operation is actually performed. By analyzing the results of such a simulation, the drilling operation and/or the drilling assembly may be selectively modified as desired to improve the drilling operation.

In order to perform an effective simulation, various information regarding well trajectory, wellbore geometry, rock properties along the wellbore and the like are gathered and meshed with characteristics of the drilling assembly. Operating parameters are selected, and a simulation is then run. Results of the simulation are then analyzed to determine the vibration, wear and tear and other properties of the drilling assembly during the drilling operation.

An accurate simulation requires creation of a model that accurately represents the actual drilling assembly and drilling operation that is to be simulated. Current models, however, are not fully satisfactory. For example, many current models do not incorporate important parameters of the drilling operation being simulated such as the effect of mass and inertia of mud that may build up in the drilling assembly during a drilling operation, and all of the various interactions between the drill bit in the drilling assembly and the rock that forms the wall of the wellbore being drilled. In addition, many current models are based on assumptions or estimates that are made regarding various parameters of the drilling operation that may not always be correct.

Despite the development and advancement of various aspects of oilfield planning, there remains a need to provide techniques for accurately simulating a drilling operation to be performed in order to provide clear understanding of the behavior of a drilling assembly during an actual drilling operation so that the drilling operation and/or the drilling assembly may be selectively modified as desired to improve the drilling operation.

SUMMARY OF THE INVENTION

Other objects, features and advantages of the present invention will become apparent to those of skill in art by reference to the figures, the description that follows and the claims.

In at least one aspect, the present invention relates to a method of performing a drilling operation for an oil field having a subterranean formation with geological structures and reservoirs therein. The method involves creating a finite-difference model to simulate behavior of a drilling assembly used to drill a wellbore in the drilling operation, performing a simulation of the drilling operation using the finite-difference model, analyzing a result of the simulation, and selectively modifying the drilling operation based on the analysis.

In another aspect, the invention relates to a method of performing a drilling operation for an oil field having a subterranean formation with geological structures and reservoirs therein. The method involves creating a model to simulate behavior of a drilling assembly used to drill a wellbore in the drilling operation, performing a simulation of the drilling operation with a set of different states using the model, analyzing a result of the simulation, and selectively modifying at least one of the drilling operation and the drilling assembly based on the analysis.

In another aspect, the present invention relates to a method of performing a drilling operation for an oil field having a subterranean formation with geological structures and reservoirs therein. The method involves creating a model of a drilling assembly, wherein the model is used to simulate behavior of the drilling assembly during drilling of a wellbore in the drilling operation within a selected tolerance when compared to using the drilling assembly to actually drill the wellbore in the drilling operation, wherein creating a model includes modeling the borehole as a visco-elastic boundary with friction and modeling interaction of a drill bit of the drilling assembly with rock along the wellbore using a formulation in which reaction forces and torques are dependent on depth of cut, rock strength and drill bit geometry. The method further involves performing a simulation of the drilling operation using the model, analyzing a result of the simulation, and selectively modifying at least one of the drilling operation and the drilling assembly based on the analysis.

In another aspect, the invention relates to a computer program product that has a computer usable medium having computer usable program code for performing a drilling operation for an oil field having a subterranean formation with geological structures and reservoirs therein. The computer program product has computer usable program code configured for creating a finite-difference model to simulate a drilling assembly while drilling a wellbore in a drilling operation, computer usable program code configured for performing a simulation of the drilling operation using the finite-difference model, computer usable program code configured for analyzing a result of the simulation, and computer usable program code configured for selectively modifying the drilling operation based on the analysis.

In another aspect, the invention relates to a computer program product that has a computer usable medium having computer usable program code for performing a drilling operation for an oil field having a subterranean formation with geological structures and reservoirs therein. The computer program product has computer usable program code configured for creating a model to simulate behavior of a drilling assembly used to drill a wellbore in the drilling operation, computer usable program code configured for performing a simulation of the drilling operation with a set of different states using the model, computer usable program code configured for analyzing a result of the simulation, and computer usable program code configured for selectively modifying at least one of the drilling operation and the drilling assembly based on the analysis.

In another aspect, the invention relates to a computer program product that has a computer usable medium having computer usable program code for performing a drilling operation for an oil field having a subterranean formation with geological structures and reservoirs therein. The computer program product has computer usable program code configured for creating a model of a drilling assembly, wherein the model is used to simulate behavior of the drilling assembly during drilling of a wellbore in the drilling operation within a selected tolerance when compared to using the drilling assembly to actually drill the wellbore in the drilling operation. The computer usable program code configured for creating a model of a drilling assembly includes computer usable program code configured for modeling the borehole as a visco-elastic boundary with friction, and computer usable program code configured for modeling interaction of a drill bit of the drilling assembly with rock along the wellbore using a formulation in which reaction forces and torques are dependent on depth of cut, rock strength, and drill bit geometry. The computer program product further includes computer usable program code configured for performing a simulation of the drilling operation using the model, computer usable program code configured for analyzing a result of the simulation, and computer usable program code configured for selectively modifying at least one of the drilling operation and the drilling assembly based on the analysis.

In another aspect, the invention relates to a system for performing a drilling operation for an oil field having a subterranean formation with geological structures and reservoirs therein. The system includes a modeling unit for creating a finite-difference model to simulate behavior of a drilling assembly used to drill a wellbore in the drilling operation, a simulation unit for performing a simulation of the drilling operation using the finite-difference model, an analyzer for analyzing a result of the simulation, and a mechanism for selectively modifying the drilling operation based on the analysis.

BRIEF DESCRIPTION OF THE DRAWINGS

FIG. 1A depicts a survey operation being performed by a seismic truck. FIG. 1B depicts a drilling operation being performed by a drilling tool suspended by a rig and advanced into the subterranean formation. FIG. 1C depicts a wireline operation being performed by a wireline tool suspended by the rig and into the wellbore of FIG. 1B. FIG. 1D depicts a production operation being performed by a production tool being deployed from the rig and into the completed wellbore of FIG. 1C for drawing fluid from the downhole reservoirs into surface facilities.

FIG. 2A depicts a seismic trace of the subterranean formation of FIG. 1A. FIG. 2B depicts core test results of the core sample of FIG. 2B. FIG. 2C depicts a well log of the subterranean formation of FIG. 1C. FIG. 2D depicts a production decline curve of fluid flowing through the subterranean formation of FIG. 1D.

FIG. 16 depicts a snap shot of a 2-D animation of BHA vibration in a horizontal well. The left first plot indicates the displacement of the BHA centerline in the vertical direction. The left second plot is the BHA displacement in the vertical direction. The left third plot shows the BHA-wellbore collision force per unit mass in units of gravity and its maximum along the BHA. The right top two plots show the rotation of bit and top in animation. The bottom right two plots show the WOB, Torque On Bit, ROP and RPM changing with time.

FIG. 17 depicts a snapshot of BHA 3-D animation representing different properties (top plot, the torsional torque; bottom plot, the axial velocity).

FIG. 18 depicts a surface plot of the RPM along BHA and time.

FIG. 19 depicts an image of RPM along BHA and time.

FIG. 20 depicts an image of axial velocity along BHA and time.

FIG. 21 depicts the energy spectrum of bit rotation at different time periods.

DETAILED DESCRIPTION OF THE INVENTION

In the following detailed description of the preferred embodiments and other embodiments of the invention, reference is made to the accompanying drawings. It is to be understood that those of skill in the art will readily see other embodiments and changes may be made without departing from the scope of the invention.

FIGS. 1A-1D illustrates an exemplary subterranean formation 100 having geological structures therein. Various measurements of the subterranean formation are taken by different tools at the same location. These measurements may be used to generate information about the formation and/or the geological structures and/or fluids contained therein.

Figure 1A:
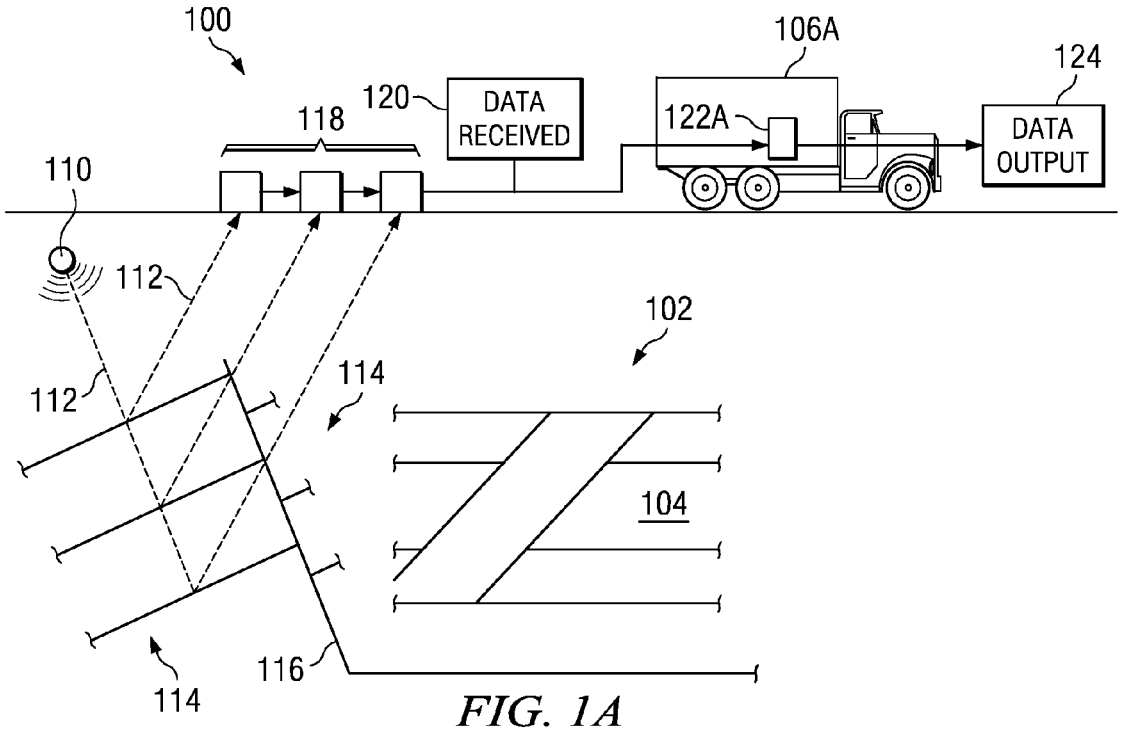
FIGS. 1A-1D depict a schematic view of an oilfield having subterranean structures containing reservoirs therein, various oilfield operations being performed on the oilfield.

FIGS. 1A-1D depict schematic views of an oilfield 100 having subterranean structures 102 containing reservoir 104 therein and depicting various oilfield operations being performed on the oilfield. FIG. 1A depicts a survey operation being performed by a seismic truck 106A to measure properties of the subterranean formation. The survey operation is a seismic survey operation for producing sound vibrations. In FIG. 1A, one such sound vibration 112 reflects off a plurality of horizons 114 in an earth formation 116. The sound vibration(s) 112 is (are) received by sensors, such as geophone-receivers 118, situated on the earth's surface, and the geophones 118 produce electrical output signals, referred to as data received 120 in FIG. 1A.

The data received 120 is representative of different parameters (such as amplitude and/or frequency) of the sound vibration(s) 112 and is provided as input data to a computer 122A of the seismic recording truck 106A, and responsive to the input data, the recording truck computer 122A generates a seismic data output record 124. The seismic data may be further processed as desired, for example, by data reduction.

Figure 1B:
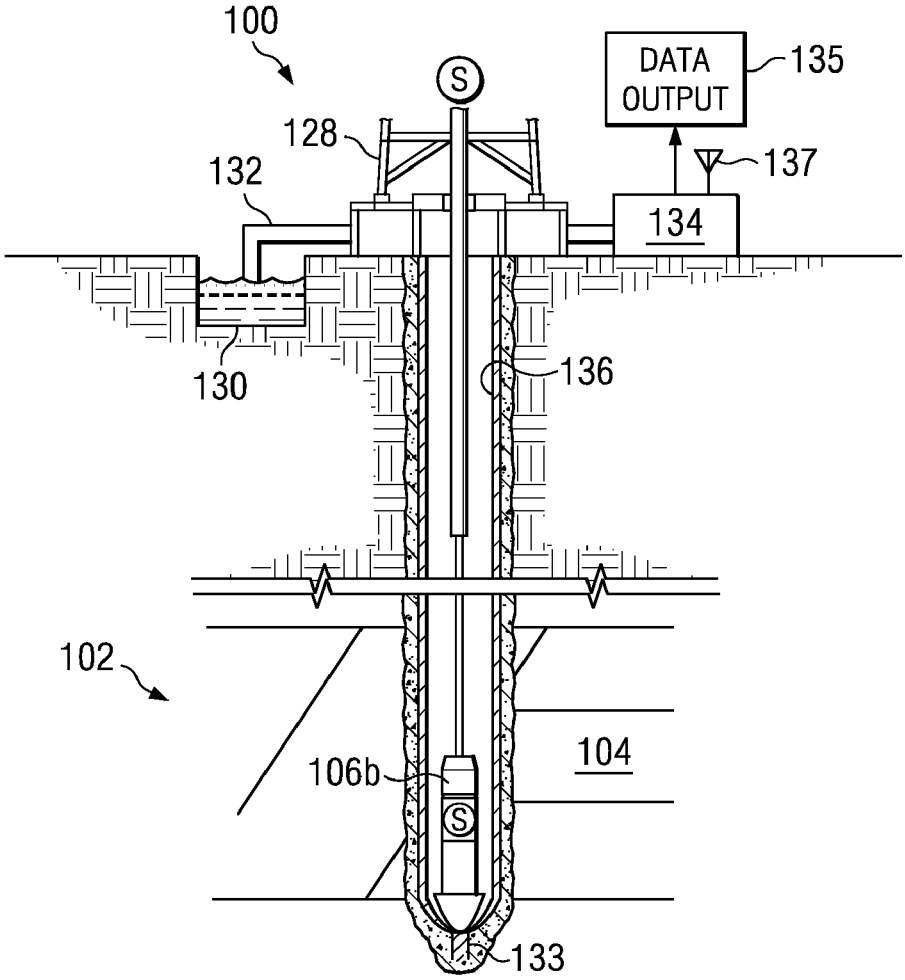

FIG. 1B depicts a drilling operation being performed by a drilling tool 106*b* suspended by a rig 128 and advanced into the subterranean formation 102 to form a wellbore 136. A mud pit 130 is used to draw drilling mud into the drilling tool via flow line 132 for circulating drilling mud through the drilling tool and back to the surface. The drilling tool is advanced into the formation to reach reservoir 104. The drilling tool is preferably adapted for measuring downhole properties. The logging while drilling tool may also be adapted for taking a core sample 133 as shown or removed so that a core sample may be taken using another tool.

A surface unit 134 is used to communicate with the drilling tool and offsite operations. The surface unit is capable of communicating with the drilling tool to send commands to drive the drilling tool and to receive data from the drilling tool. The surface unit is preferably provided with computer facilities for receiving, storing, processing and analyzing data from the oilfield. The surface unit collects data output 135 generated during the drilling operation. Computer facilities, such as those of the surface unit, may be positioned at various locations about the oilfield and/or at remote locations.

Sensors S, such as gauges, may be positioned throughout the reservoir, rig, oilfield equipment (such as the downhole tool), or other portions of the oilfield for gathering information about various parameters, such as surface parameters, downhole parameters, and/or operating conditions. These sensors preferably measure oilfield parameters, such as weight on bit, torque on bit, pressures, temperatures, flow rates, compositions, measured depth, azimuth, inclination, and other parameters of the oilfield operation.

The information gathered by the sensors may be collected by the surface unit and/or other data collection sources for analysis or other processing. The data collected by the sensors may be used alone or in combination with other data. The data may be collected in a database and all or select portions of the data may be selectively used for analyzing and/or predicting oilfield operations of the current and/or other wellbores.

Data outputs from the various sensors positioned about the oilfield may be processed for use. The data may be historical data, real time data, or combinations thereof. The real time data may be used in real time or stored for later use. The data may also be combined with historical data or other inputs for further analysis. The data may be housed in separate databases or combined into a single database.

The collected data may be used to perform analysis, such as modeling operations. For example, the seismic data output may be used to perform geological, geophysical, and/or reservoir engineering simulations. The reservoir, wellbore, surface and/or process data may be used to perform reservoir, wellbore, or other production simulations. The data outputs from the oilfield operation may be generated directly from the sensors or after some preprocessing or modeling. These data outputs may act as inputs for further analysis.

The data is collected and stored at the surface unit 134. One or more surface units may be located at the oilfield or linked remotely thereto. The surface unit may be a single unit or a complex network of units used to perform the necessary data management functions throughout the oilfield. The surface unit may be a manual or automatic system. The surface unit may be operated and/or adjusted by a user.

The surface unit may be provided with a transceiver 137 to allow communications between the surface unit and various portions of the oilfield and/or other locations. The surface unit may also be provided with or functionally linked to a controller for actuating mechanisms at the oilfield. The surface unit may then send command signals to the oilfield in response to data received. The surface unit may receive commands via the transceiver or may itself execute commands to the controller. A processor may be provided to analyze the data (locally or remotely) and make the decisions to actuate the controller. In this manner, the oilfield may be selectively adjusted based on the data collected. These adjustments may be made automatically based on computer protocol or manually by an operator. In some cases, well plans and/or well placement may be adjusted to select optimum operating conditions or to avoid problems.

Figure 1C:
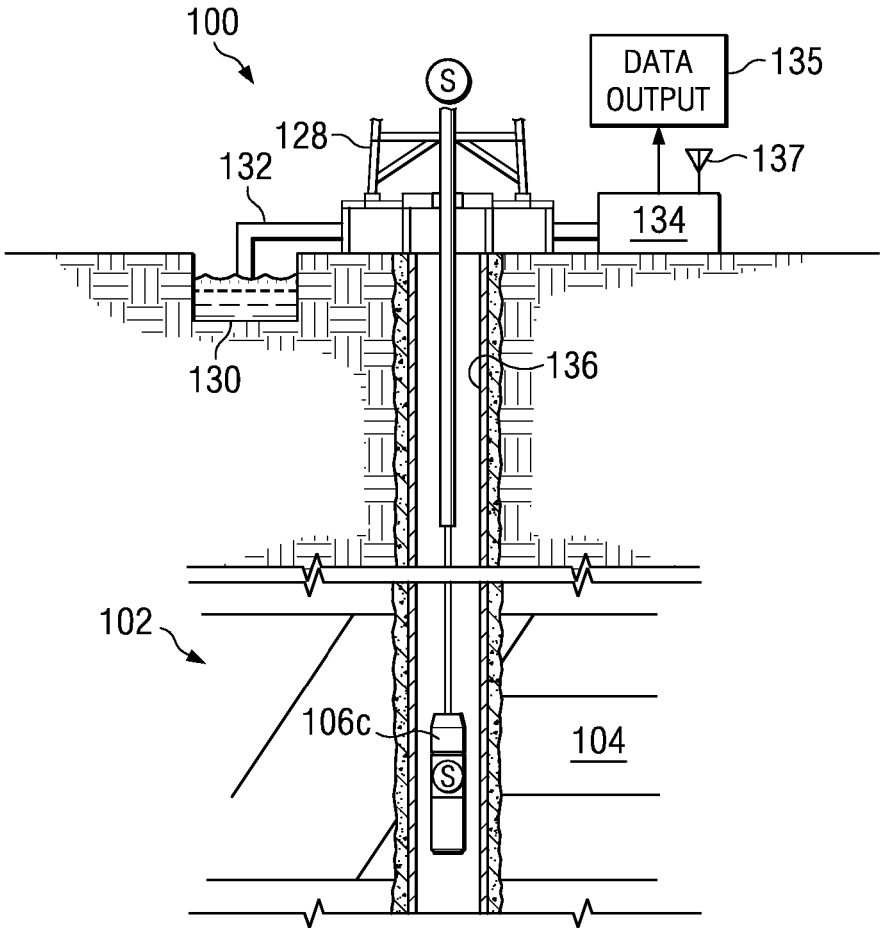

FIG. 1C depicts a wireline operation being performed by a wireline tool 106*c* suspended by the rig 128 and into the wellbore 136 of FIG. 1B. The wireline tool is preferably adapted for deployment into a wellbore for performing well logs, performing downhole tests and/or collecting samples. The wireline tool may be used to provide another method and apparatus for performing a seismic survey operation. The wireline tool of FIG. 1C may have an explosive or acoustic energy source 144 that provides electrical signals to the surrounding subterranean formations 102.

The wireline tool may be operatively linked to, for example, the geophones 118 stored in the computer 122A of the seismic recording truck 106A of FIG. 1A. The wireline tool may also provide data to the surface unit 134. As shown data output 135 is generated by the wireline tool and collected at the surface. The wireline tool may be positioned at various depths in the wellbore to provide a survey of the subterranean formation.

Figure 1D:
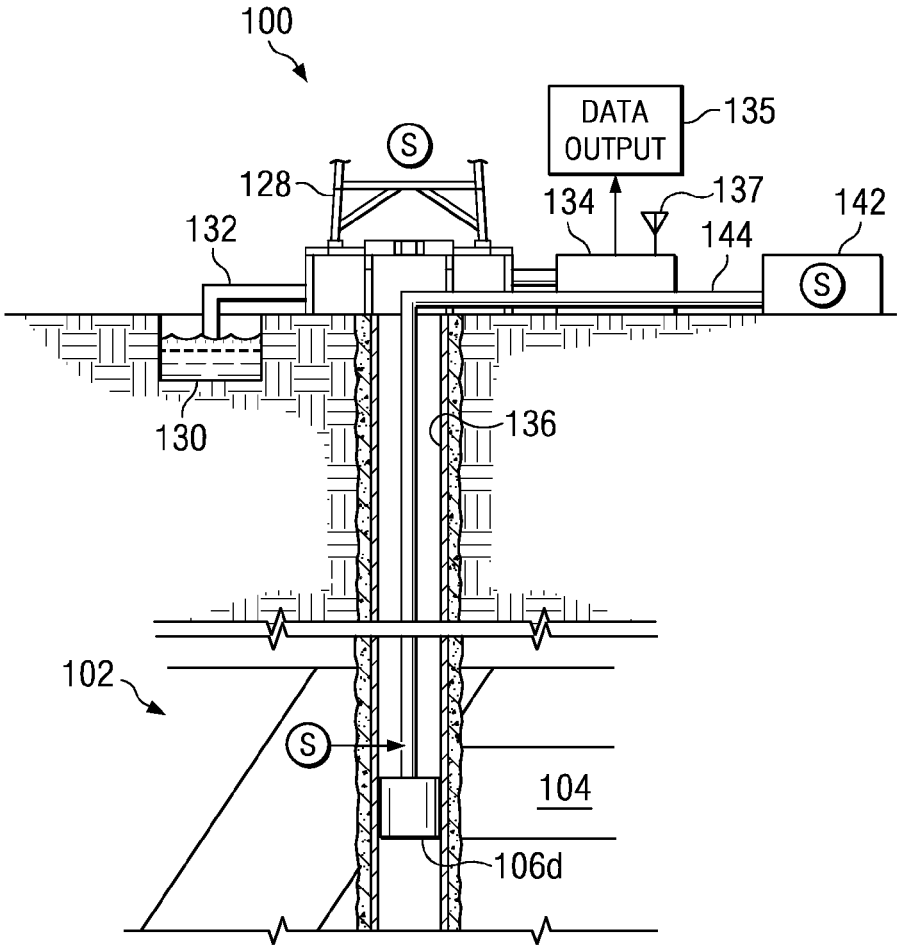

FIG. 1D depicts a production operation being performed by a production tool 106*d* deployed from the rig 128 and into the completed wellbore 136 of FIG. 1C for drawing fluid from the downhole reservoirs into surface facilities 142. Fluid flows from reservoir 104 through wellbore 136 and to surface facilities 142 via a gathering network 144. Sensors S positioned about the oilfield are operatively connected to a surface unit 142 for collecting data therefrom. During the production process, data output 135 may be collected from various sensors and passed to the surface unit and/or processing facilities. This data may be, for example, reservoir data, wellbore data, surface data and/or process data.

While only one wellsite is shown, it will be appreciated that the oilfield may cover a portion of land that hosts one or more wellsites. One or more gathering facilities may be operatively connected to one or more of the wellsites for selectively collecting downhole fluids from the wellsite(s).

Throughout the oilfield operations depicted in FIGS. 1A-1D, there are numerous business considerations. For example, the equipment used in each of these figures has various costs and/or risks associated therewith. At least some of the data collected at the oilfield relates to business considerations, such as value and risk. This business data may include, for example, production costs, rig time, storage fees, price of oil/gas, weather considerations, political stability, tax rates, equipment availability, geological environment, and other factors that affect the cost of performing the oilfield operations or potential liabilities relating thereto. Decisions may be made and strategic business plans developed to alleviate potential costs and risks. For example, an oilfield plan may be based on these business considerations. Such an oilfield plan may, for example, determine the location of the rig, as well as the depth, number of wells, duration of operation, and other factors that will affect the costs and risks associated with the oilfield operation.

While FIG. 1A-1D depicts monitoring tools used to measure properties of an oilfield, it will be appreciated that the tools may be used in connection with non-oilfield operations, such as mines, aquifers, or other subterranean facilities. Also, while certain data acquisition tools are depicted, it will be appreciated that various measurement tools capable of sensing properties, such as seismic two-way travel time, density, resistivity, production rate, etc., of the subterranean formation and/or its geological structures may be used. Various sensors S may be located at various positions along the subterranean formation and/or the monitoring tools to collect and/or monitor the desired data. Other sources of data may also be provided from offsite locations.

The oilfield configuration of FIG. 1 is not intended to limit the scope of the invention. Part or all of the oilfield may be on land and/or sea. Also, while a single oilfield measured at a single location is depicted, the present invention may be utilized with any combination of one or more oilfields, one or more processing facilities and one or more wellsites.

Figure 2A:
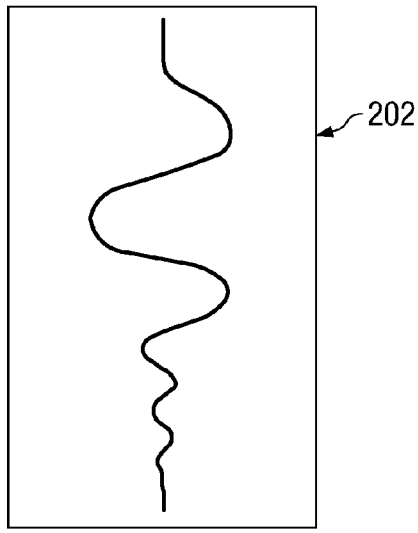
FIGS. 2A-2D are graphical depictions of data collected by the tools of FIGS. 1A-1D, respectively.
Figure 2B:
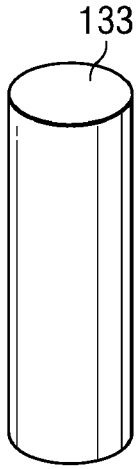
Figure 2C:
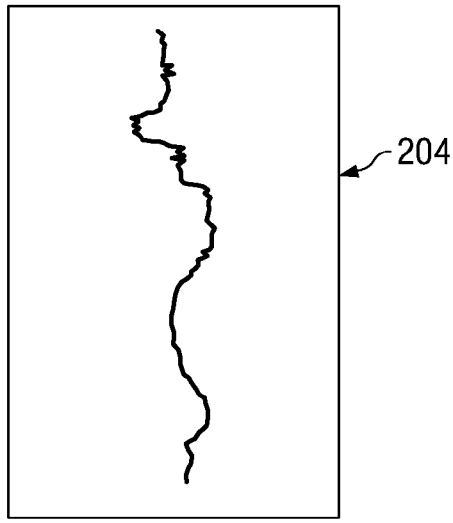
Figure 2D:
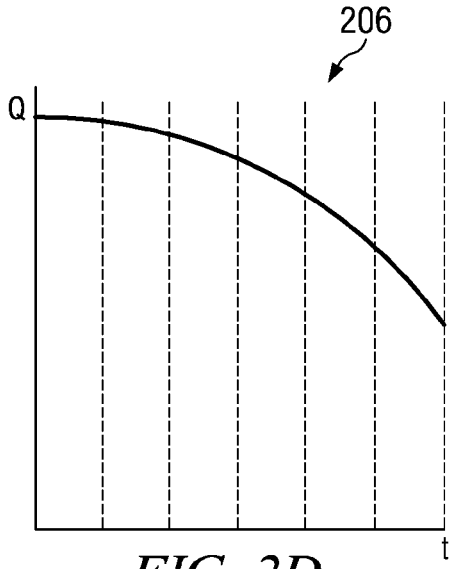

FIGS. 2A-2D are graphical depictions of data collected by the tools of FIGS. 1A-1D, respectively. FIG. 2A depicts a seismic trace 202 of the subterranean formation of FIG. 1A taken by survey tool 106A. The seismic trace measures the two-way response over a period of time. FIG. 2B depicts a core sample 133 taken by the logging tool 106*b*. The core test typically provides a graph of the density, resistivity or other physical property of the core sample over the length of the core. FIG. 2C depicts a well log 204 of the subterranean formation of FIG. 1C taken by the wireline tool 106*c*. The wireline log typically provides a resistivity measurement of the formation at various depths. FIG. 2D depicts a production decline curve 206 of fluid flowing through the subterranean formation of FIG. 1D taken by the production tool 106*d*. The production decline curve typically provides the production rate Q as a function of time t.

The respective graphs of FIGS. 2A-2C contain static measurements that describe the physical characteristics of the formation. These measurements may be compared to determine the accuracy of the measurements and/or for checking for errors. In this manner, the plots of each of the respective measurements may be aligned and scaled for comparison and verification of the properties.

FIG. 2D provides a dynamic measurement of the fluid properties through the wellbore. As the fluid flows through the wellbore, measurements are taken of fluid properties, such as flow rates, pressures, composition, etc. As described below, the static and dynamic measurements may be used to generate models of the subterranean formation to determine characteristics thereof.

The models may be used to create an earth model defining the subsurface conditions. This earth model predicts the structure and its behavior as oilfield operations occur. As new information is gathered, part or all of the earth model may need adjustment.

Figure 3:
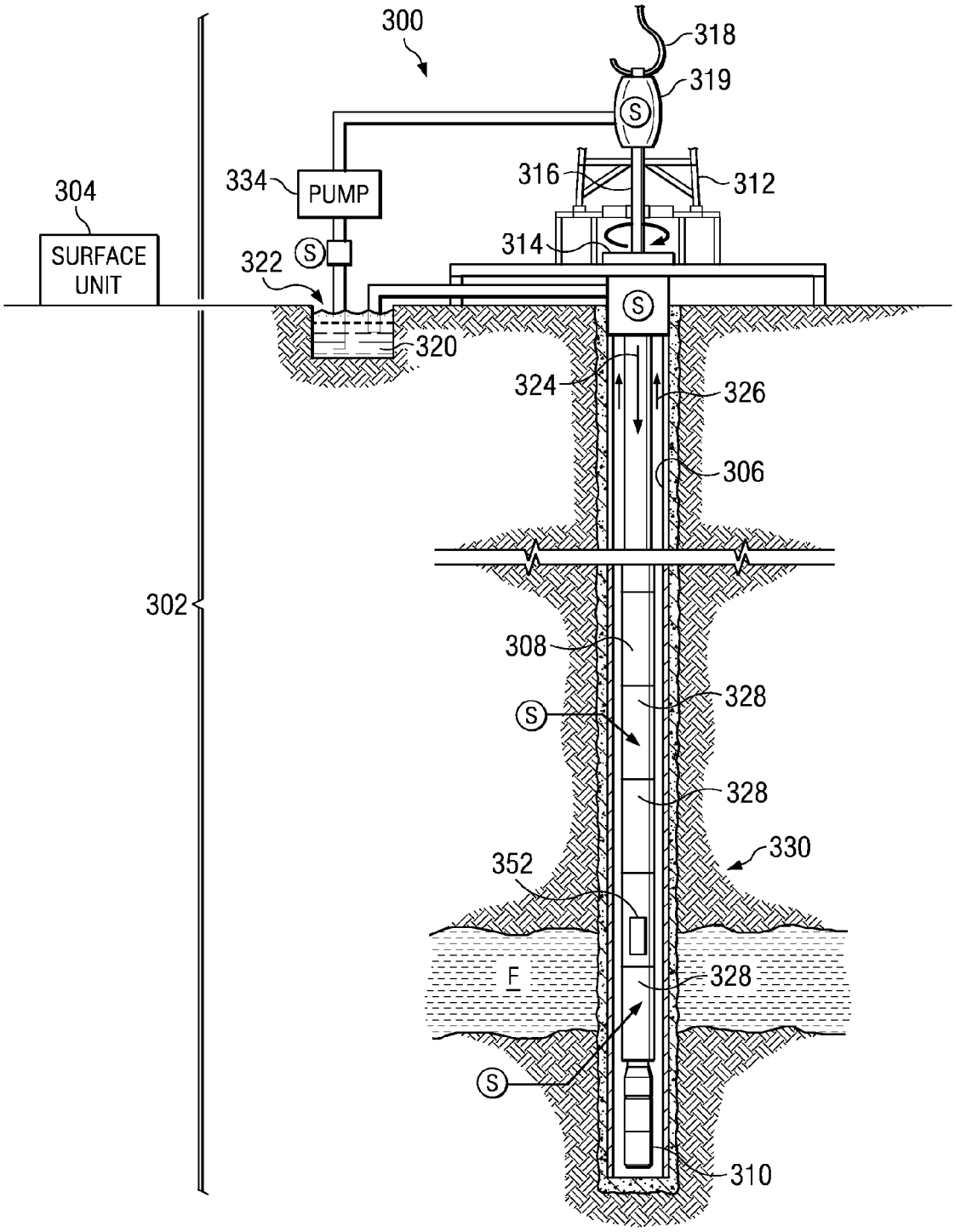
FIG. 3 is a schematic view, partially in cross-section, of a drilling operation of an oilfield in accordance with a preferred embodiment of the present invention.

FIG. 3 is a schematic view of a wellsite 300 depicting a drilling operation, such as the drilling operation of FIG. 1B, of an oilfield in greater detail. The wellsite system 300 includes a drilling system 302 and a surface unit 304. In the illustrated embodiment, a borehole 306 is formed by rotary drilling in a manner that is well known. Those of ordinary skill in the art given the benefit of this disclosure will appreciate, however, that the present invention also finds application in drilling applications other than conventional rotary drilling (e.g., mud-motor based directional drilling), and is not limited to land-based rigs.

Drilling system 302 includes a drill string 308 suspended within the borehole 306 with a drill bit 310 at its lower end. The drilling system 302 also includes the land-based platform and derrick assembly 312 positioned over the borehole 306 penetrating a subsurface formation F. The assembly 312 includes a rotary table 314, kelly 316, hook 318 and rotary swivel 319. The drill string 308 is rotated by the rotary table 314, energized by means not shown, which engages the kelly 316 at the upper end of the drill string. The drill string 308 is suspended from hook 318, attached to a traveling block (also not shown), through the kelly 316 and a rotary swivel 319 which permits rotation of the drill string relative to the hook.

The surface system further includes drilling fluid or mud 320 stored in a pit 322 formed at the well site. A pump 334 delivers the drilling fluid 320 to the interior of the drill string 308 via a port in the swivel 319, inducing the drilling fluid to flow downwardly through the drill string 308 as indicated by the directional arrow 324. The drilling fluid exits the drill string 308 via ports in the drill bit 310, and then, circulates upwardly through the region between the outside of the drill string and the wall of the borehole, called the annulus, as indicated by the directional arrows 326. In this manner, the drilling fluid lubricates the drill bit 310 and carries formation cuttings up to the surface as it is returned to the pit 322 for recirculation.

The drill string 308 further includes a bottom hole assembly (BHA), generally referred to as 330, near the drill bit 310 (in other words, within several drill collar lengths from the drill bit). The bottom hole assembly includes capabilities for measuring, processing, and storing information, as well as communicating with the surface unit. Additionally, the BHA can include mud motors and/or rotary steerable assemblies and reamers, which may divert some fluid flow being pumped into the drill string assemble to the annulus. The BHA 308 further includes drill collars 328 for performing various other measurement functions.

Sensors S are located about the wellsite to collect data, preferably in real time, concerning the operation of the wellsite, as well as conditions at the wellsite. The sensors S of FIG. 3 may be the same as the sensors of FIGS. 1A-1D. The sensors of FIG. 3 may also have features or capabilities of monitors, such as cameras (not shown), to provide pictures of the operation. Surface sensors or gauges S may be deployed about the surface systems to provide information about the surface unit, such as standpipe pressure, hookload, depth, surface torque, rotary rpm, among others. Downhole sensors or gauges S are disposed about the drilling tool and/or wellbore to provide information about downhole conditions, such as wellbore pressure, weight on bit, torque on bit, direction, inclination, collar rpm, tool temperature, annular temperature, and toolface among others. The information collected by the sensors and cameras is conveyed to the various parts of the drilling system and/or the surface control unit.

The drilling system 302 is operatively connected to the surface unit 304 for communication therewith. The BHA is provided with a communication subassembly 352 that communicates with the surface unit. The communication subassembly 352 is adapted to send signals to and receive signals from the surface using mud pulse telemetry. The communication subassembly may include, for example, a transmitter that generates a signal, such as an acoustic or electromagnetic signal, which is representative of the measured drilling parameters. Communication between the downhole and surface systems is depicted as being mud pulse telemetry, such as the one described in U.S. Pat. No. 5,517,464, assigned to the assignee of the present invention. It will be appreciated by one of ordinary skill in the art that a variety of telemetry systems may be employed, such as wired drill pipe, electromagnetic or other known telemetry systems.

Typically, the wellbore is drilled according to a drilling plan that is established prior to drilling. The drilling plan typically sets forth equipment, pressures, trajectories and/or other parameters that define the drilling process for the wellsite. The drilling operation may then be performed according to the drilling plan. However, as information is gathered, the drilling operation may need to deviate from the drilling plan. Additionally, as drilling or other operations are performed, the subsurface conditions may change. The earth model may also need adjustment as new information is collected.

Further, the different embodiments allow for simulations of the drilling equipment to be made. The results of these simulations may be used to alter operating parameters, such as the drilling fluid used in the drill string or the speed at which the drill bit rotates. Other changes may be made to the drilling operations, such as changing components in the drill string, such as the BHA or the drill bit, to optimize the drilling operations. These optimizations in the drilling operations may include, for example, the speed at which the wellbore is created or how long different components in the drill string last before wearing out.

Figure 4:
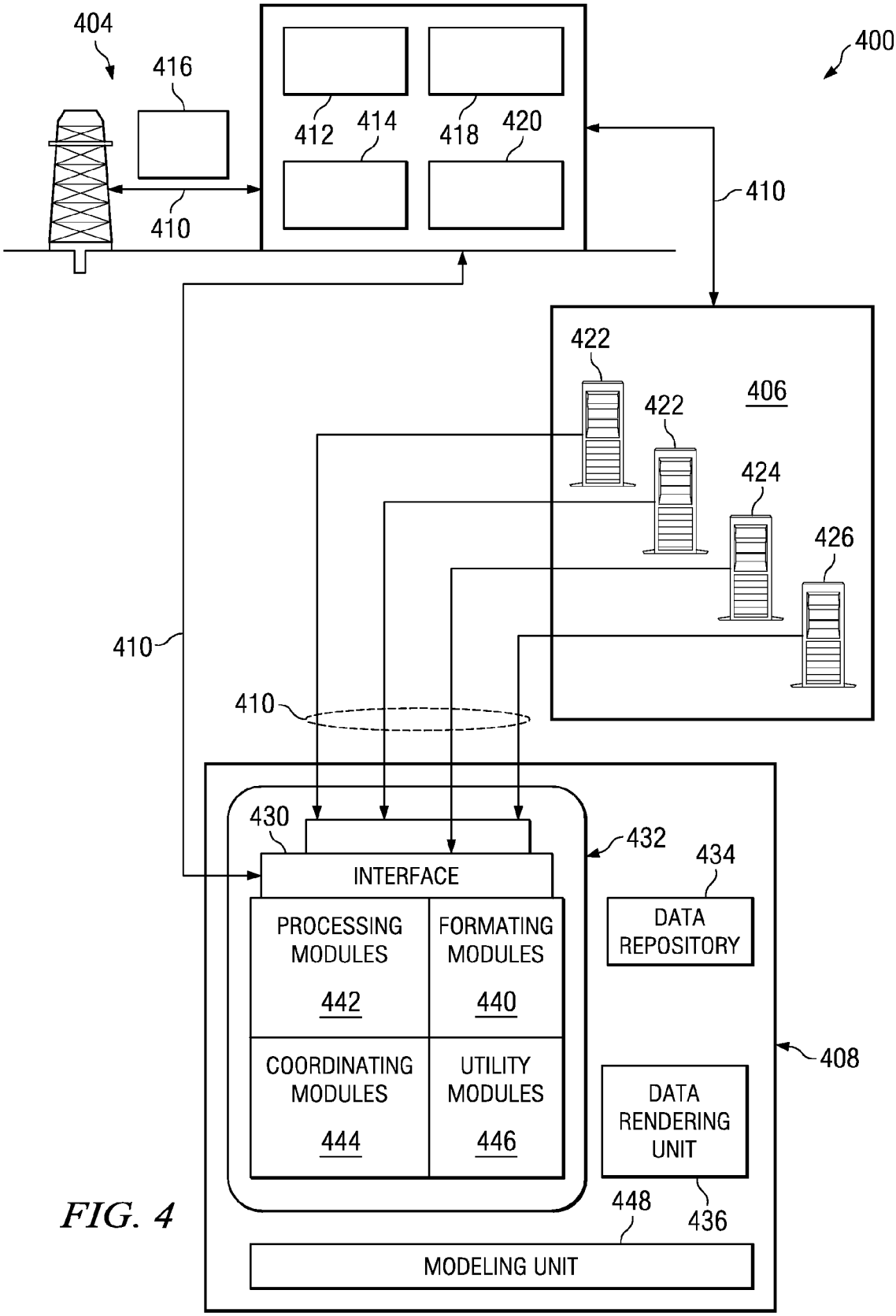
FIG. 4 is a schematic diagram depicting a system for performing a drilling operation of an oilfield in accordance with a preferred embodiment of the present invention.

FIG. 4 is a schematic diagram depicting a system for performing a drilling operation of an oilfield. As shown, the system includes a surface unit 402 operatively connected to a wellsite 404, servers 406 operatively linked to the surface unit, and a modeling tool 408 operatively linked to the servers. As shown, communication links 410 are provided between the wellsite, surface unit, servers, and modeling tool. A variety of links may be provided to facilitate the flow of data through the system. The communication links 410 may provide for continuous, intermittent, one-way, two-way, and/or selective communication throughout the system. Communication links 410 may be of any type, such as wired, wireless, etc.

The wellsite 404 and surface unit 402 may be the same as the wellsite and surface unit of FIG. 3. The surface unit is preferably provided with an acquisition component 412, a controller 414, a display unit 416, a processor 418 and a transceiver 420. The acquisition component 412 collects and/or stores data of the oilfield. This data may be data measured by the sensors S of the wellsite 404 as described with respect to FIG. 3. This data may also be data received from other sources.

The controller 414 is enabled to enact commands at the oilfield. The controller 414 may be provided with actuation means that can perform drilling operations, such as steering, advancing, or otherwise taking action at the wellsite 404. Commands may be generated based on logic of the processor 418 or by commands received from other sources. The processor 418 is preferably provided with features for manipulating and analyzing the data. The processor 418 may be provided with additional functionality to perform oilfield operations.

A display unit 416 may be provided at the wellsite 404 and/or remote locations for viewing actual oilfield data as well as data for simulations based on the oilfield data. In these examples, display unit 416 also is used to view output resulting from simulations of drilling operations. The oilfield data displayed may be raw data, processed data and/or data outputs generated from various data. The display unit 416 is preferably adapted to provide flexible views of the data, so that the screens depicted may be customized as desired. The different outputs presented by display unit 416 may be used to modify, direct or alter drilling operations at well site 404. The modifications and changes may include, for example, selecting different components for the drill string or a different drill bit. Further, these modifications and changes may be to operating parameters for the drilling operations.

The transceiver 420 provides a means for providing data access to and/or from other sources. The transceiver 420 also provides a means for communicating with other components, such as the servers 406, the wellsite 404, surface unit 402, and/or the modeling tool 408.

The server 406 may be used to transfer data from one or more wellsites to the modeling tool 408. As shown, the server 406 includes onsite servers 422, a remote server 424, and a third party server 426. The onsite servers 422 may be positioned at the wellsite and/or other locations for distributing data from the surface unit. The remote server 424 is positioned at a location away from the oilfield and provides data from remote sources. The third party server 426 may be onsite or remote, but it is operated by a third party, such as a client.

The servers are preferably capable of transferring drilling data, such as logs, drilling events, trajectory, and/or other oilfield data, such as seismic data, historical data, economics data, or other data that may be of use during analysis. This data may be used along with data describing a drill string to create models to simulate drilling operations. The other data includes, for example, data used to model a drill bit or BHA in the drill string.

The servers communicate with the modeling tool 408 as indicated by the communication links 410 there between. In these examples, the processes used to model and simulate drilling operations using a model of a drill string may be implemented in modeling unit 448. Of course, these processes may be implemented in other software components or distributed in other components, depending on the particular implementation. As indicated by the multiple arrows, the servers may have separate communication links with the modeling tool 408. One or more of the servers may be combined or linked to provide a combined communication link.

The servers collect a wide variety of data. The data may be collected from a variety of channels that provide a certain type of data, such as well logs. The data from the servers is passed to the modeling tool 408 for processing. The servers may be used to store and/or transfer data.

The modeling tool 408 is operatively linked to the surface unit for receiving data there from. In some cases, the modeling tool and/or server(s) may be positioned at the wellsite 404. The modeling tool 408 and/or server(s) may also be positioned at various locations. The modeling tool 408 may be operatively linked to the surface unit via the server(s). The modeling tool 408 may also be included in or located near the surface unit 402.

The modeling tool 408 includes an interface 430, a processing unit 432, a modeling unit 448, a data repository 434 and a data rendering unit 436. The interface 430 communicates with other components, such as the servers 406. The interface 430 may also permit communication with other oilfield or non-oilfield sources. The interface 430 receives the data and maps the data for processing. Data from servers typically streams along predefined channels which may be selected by the interface 430.

As depicted in FIG. 4, the interface 430 selects the data channel of the server(s) and receives the data. The interface 430 also maps the data channels to data from the wellsite. The data may then be passed to the processing unit of the modeling tool.

The processing unit 432 includes formatting modules 440, processing modules 442, coordinating modules 444 and utility modules 446. These modules may manipulate the oilfield data for real-time analysis.

The coordinating modules 444 orchestrate the data flow throughout the modeling tool 408. The data is manipulated so that it flows according to a choreographed plan. The data may be queued and synchronized so that it processes according to a timer and/or a given queue size.

The utility modules 446 provide support functions to the drilling system. The data repository 434 stores the data for the modeling unit 448. The data may include models of drill strings and other drilling equipment. In the illustrative embodiments these models take the form of finite-difference models.

The data is passed to the data repository 434 from the processing component. It can be persisted in the file system (e.g., as an XML File) or in a database. The system determines which storage is the most appropriate to use for a given piece of data and stores the data there in a manner which enables automatic flow of the data through the rest of the system in a seamless and integrated fashion. It also facilitates manual and automated workflows (such as Modeling, Geological & Geophysical ones) based upon the persisted data.

The data rendering unit 436 provides one or more displays for visualizing the data. The rendering unit may contain a 3D canvas, a well section canvas or other canvases as desired. The rendering unit may selectively display any combination of one or more canvases. The canvases may or may not be synchronized with each other during display. The display unit is preferably provided with mechanisms for actuating various canvases or other functions in the system. Output for visualizing results from simulations of equipment, such as a drill string, may be generated using data rendering unit 436 in these illustrative embodiments Modeling unit 448 performs the modeling functions for generating complex oilfield outputs. The modeling unit 448 is capable of performing modeling functions, such as generating, analyzing and manipulating earth models. The earth models typically contain exploration and production data, such as that shown in FIG. 1. Additionally in the illustrative embodiments, modeling unit 448 may simulate drilling operations in different earth models using models of drilling equipment, such as drill strings and their interaction with the walls of a borehole.

The illustrative embodiments relate to modeling mechanisms for simulating the transient behavior of a drilling assembly, for example, a bottom hole assembly (BHA) or an entire drill string, while drilling an underground formation. In accordance with illustrative embodiments, each element of a drilling assembly, for example, the drill bit, collars, MWD (measurement-while-drilling)/LWD (logging-while-drilling) tools, pipes, etc., is modeled as a combination of many short segments which are treated as elastic rods subject to axial and shear loads, as well as to bending and torsional moments that will be encountered during an actual drilling operation being simulated. The borehole wall is modeled as a visco-elastic boundary with friction. The borehole mud drag on the drilling assembly is treated as a viscous drag (radial, axial and rotational drags included). The drill bit interaction with the rock is modeled using an empirically based formulation in which reaction forces and torques are mainly dependent on the depth of cut (thickness of rock layer cut per revolution), rock strength and bit geometry. Special tools/drilling elements are modeled specifically, such as downhole drill motor, rotary steering system, special joints/cross-over, etc. The top boundary condition is modeled using a feedback controlled motor model.

In accordance with illustrative embodiments, finite-difference schemes in both space and time are used to simulate the dynamic behavior of the drill string-bit-rock interaction.

Figure 5:
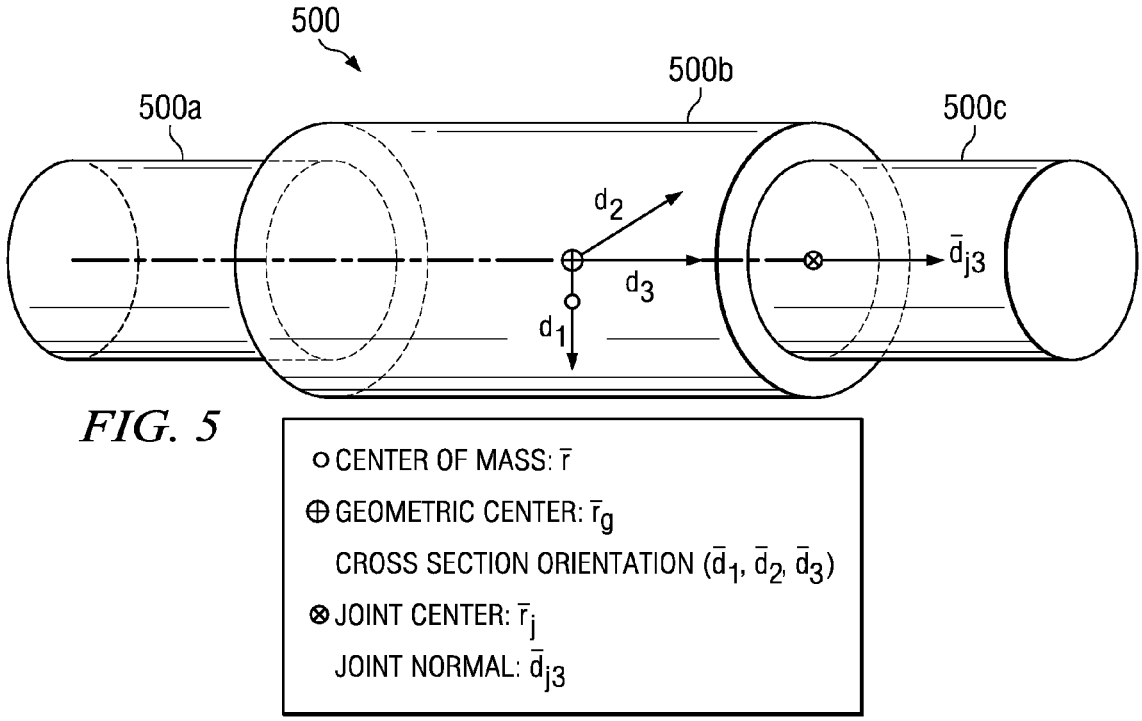
FIG. 5 is a diagram that schematically depicts the finite-difference grid used for modeling of the transient dynamics of a BHA/drill string according to in accordance with a preferred embodiment of the present invention.

The different illustrative embodiments use finite-difference models of the drilling assembly in the simulations of drilling operations. Finite-difference is a mathematical expression used in numerical analysis in which finite-differences are used to approximate derivatives. In the illustrative embodiments, models of drilling equipment, such as a drilling assembly or even surface equipment are generated using finite-difference methods. These models are finite-difference models. FIG. 5 is a diagram that schematically depicts the finite-difference grid used for modeling the transient dynamics of the BHA/drill string to form a finite-difference model according to an illustrative embodiment. As illustrated, a drilling assembly, generally designated by reference number 500, is treated as a piecewise string of cylindrical segments 500*a*, 500*b* and 500*c*. Drilling assembly 500 may, for example, be implemented as components of BHA 308 illustrated in FIG. 3. In other words, a drilling assembly, such as a drill string or a BHA, may be modeled using segments.

A staggered grid scheme is used in these depicted examples. The location (center of mass and geometric center), orientation, and linear and angular speeds are recorded at the mid-span of each segment. The internal forces and moments acting between adjacent segments (such as the extensional force, shear force, bending moment and torsional moment) are recorded at the joints.

It is noted that the location of the center of mass of each segment 500*a*, 500*b*, and 500*c* does not need to coincide with the geometric center. For instance, FIG. 5 shows a BHA segment in which the center of mass lies at a distance along the principal direction, from the geometric center of the segment.

Figure 6:
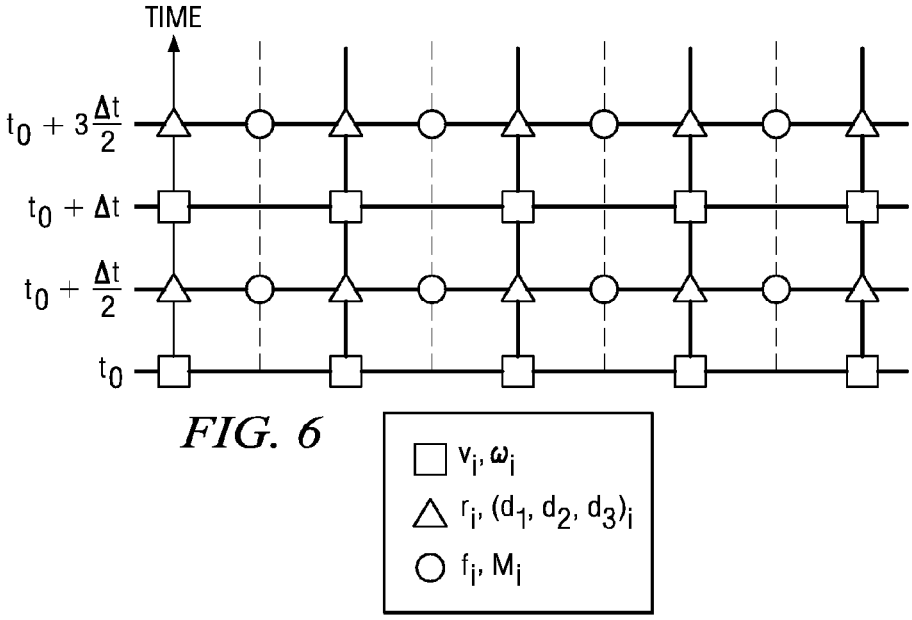
FIG. 6 depicts a time staggering scheme used for modeling of the transient dynamics of a BHA/drill string in accordance with a preferred embodiment of the present invention.

Updating of the discretized system schematically illustrated in FIG. 5 in time is also staggered. FIG. 6 depicts a time staggering scheme used for modeling of the transient dynamics of a BHA/drillstring, such as illustrated in FIG. 3 according to an illustrative embodiment. This scheme may be employed in generating a finite-difference model of the drilling assembly in these examples. FIG. 5 shows three such segments.

As shown in FIG. 6, the linear and angular velocities are updated at time $(t_0+n\cdot\Delta t)$, then the positions and orientations are updated at time $(t_0+(n+\frac{1}{2})\cdot\Delta t)$, then the internal forces and moments at the joints at time $(t_0+(n+\frac{1}{2})\cdot\Delta t)$, are computed (this is done based on the assumption that the drilling assembly's material is elastic; and, therefore, the internal forces and moments are functions of the relative position and orientation changes between adjacent segments). Finally the linear and angular velocities are updated at time $(t_0+(n+1)\cdot\Delta t)$.

Those skilled in the art will understand that since an explicit central difference scheme is used, the time increment $\Delta t$ will be limited by well known conditions dictated by numerical stability.

Each drilling assembly segment is considered as a rigid body. Accordingly, the segment motion equations, when written in the segment principal axes (($\vec{d}_1$, $\vec{d}_2$, $\vec{d}_3$), are:

$$m\dot{\vec{v}} = \vec{F}$$

$$I_1\dot{\omega}_1 = (I_3 - I_2)\omega_2\omega_3 + T_1$$

$$I_2\dot{\omega}_2 = (I_1 - I_3)\omega_3\omega_1 + T_2$$

$$I_3\dot{\omega}_3 = (I_2 - I_1)\omega_1\omega_2 + T_3$$

and, when written in discretized form are:

$$m\frac{v_i^{n+1} - v_i^n}{\Delta t} = F_i\left(\frac{v_j^{n+1} + v_j^n}{2}, \frac{\omega_j^{n+1} + \omega_j^n}{2}; r_j^{n+1/2}, d_{i,j}^{n+1/2}\right) + F_i'(r_j^{n+1/2}, d_{i,j}^{n+1/2})$$

$$I_i\frac{\omega_i^{n+1} - \omega_i^n}{\Delta t} = \varepsilon_{ikl}(I_l - I_k)\omega_k\omega_l + T_i\left(\frac{v_j^{n+1} + v_j^n}{2}, \frac{\omega_j^{n+1} + \omega_j^n}{2}; r_j^{n+1/2}, d_{i,j}^{n+1/2}\right) + T_i'(r_j^{n+1/2}, d_{i,j}^{n+1/2})$$

Here, the force/torque are slipped into two parts according to whether or not they depend on linear or angular velocities. The internal forces acting on a joint, the gravity force (with buoyancy effect), do not depend on the velocities; but the mud force, the interactive force with rock, and the top driving force/torque are functions of velocities.

For each segment, the motion equations are a system of six coupled nonlinear differential equations as:

$$M\frac{x^{n+1} - x^n}{\Delta t} = f\left(\frac{x^{n+1} - x^n}{2}\right)$$

where M is the mass matrix, x is a vector consisting of the three linear and three angular velocities, and f is the forcing vector which includes velocity dependent forces.

The Newton-Raphson iteration is used as a solution procedure, as described by the following equation:

$$\left[\frac{M}{\Delta t} - \frac{1}{2}\left(\frac{\partial f}{\partial x}\right)_{x^n + \frac{\Delta x_k^n}{2}}\right]\Delta x_{k+1}^n = f\left(x^n + \frac{\Delta x_k^n}{2}\right) - \left(\frac{\partial f}{\partial x}\right)_{x^n + \frac{\Delta x_k^n}{2}} \cdot \frac{\Delta x_k^n}{2}$$

where k is the iteration index, and $\Delta x_0^n = 0$.

Once the velocities are updated, the position can be updated by:

$$\frac{r_i^{n+3/2} - r_i^{n+1/2}}{\Delta t} = v_i^{n+1}$$

in the global coordinate system.

Figure 7:
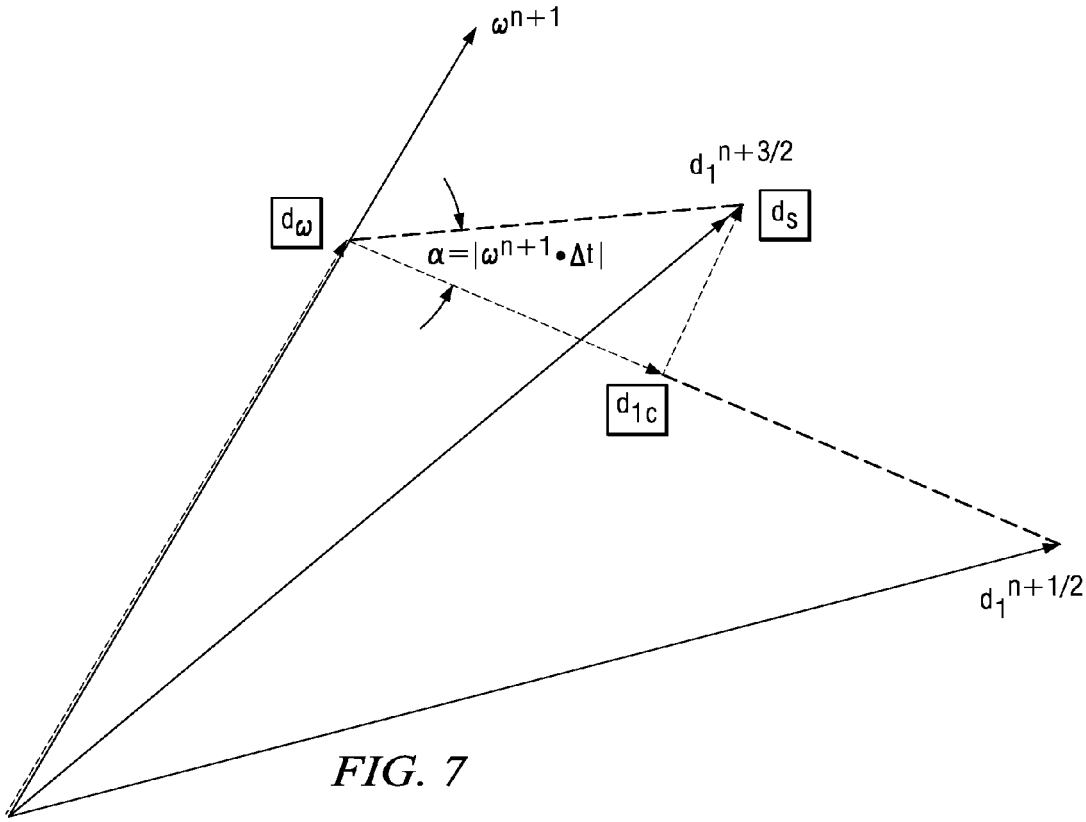
FIG. 7 depicts a diagram to assist in explaining the motion equations in accordance with a preferred embodiment of the present invention.

The orientation can be updated as shown in FIG. 7 with reference to the following equations, which depicts a diagram to assist in explaining the motion equations according to an illustrative embodiment:

$$d_1^{n+3/2} = d_\omega + d_{1c} + d_s,$$

where $$d_\omega = (d_1^{n+1/2} \cdot u_\omega)u_\omega, \text{ and } u_\omega = \frac{\omega}{|\omega|}.$$

$$d_{1c} = \cos(\alpha)(d_1 - d_\omega),$$

and $$d_s = \sin(\alpha)(u_\omega \times d_1), \text{ thus}$$

$$d_1^{n+3/2} = (1 - \cos\alpha)(d_1^{n+1/2} \cdot u_\omega)u_\omega \cos\alpha \cdot d_1^{n+1/2} + \sin\alpha \cdot (u_\omega \times d_1^{n+1/2})$$

A similar procedure is used to update $d_2$ and $d_3$.

When a drilling assembly segment moves laterally, the mud inside the segment is sufficiently constrained in that it will tend to experience the same lateral movement as the drilling assembly, and the same is true for lateral rotations. Thus, for lateral movement, an effective mud mass should be added, and for lateral rotations (along $d_{1,2}$), an effective mud rotational inertia should also be added.

For each segment, the forces include:

1. the extensional forces on each side of the segment;
2. the shear forces on each side of the segment;
3. the gravity force with mud buoyancy effect; and
4. other external forces, including mud drag forces, rock collision force while interacting with rock, bit-rock force and top-driving force.

For each segment, the torques include:

1. internal bending moments on each side of the segment;
2. internal torsional moments on each side of the segment;
3. the torques caused by the extensional forces and shear forces; and
4. other external moments such as any torque due to mud drag effects, the rock interaction torque and the torque applied at the top.

Figure 8:
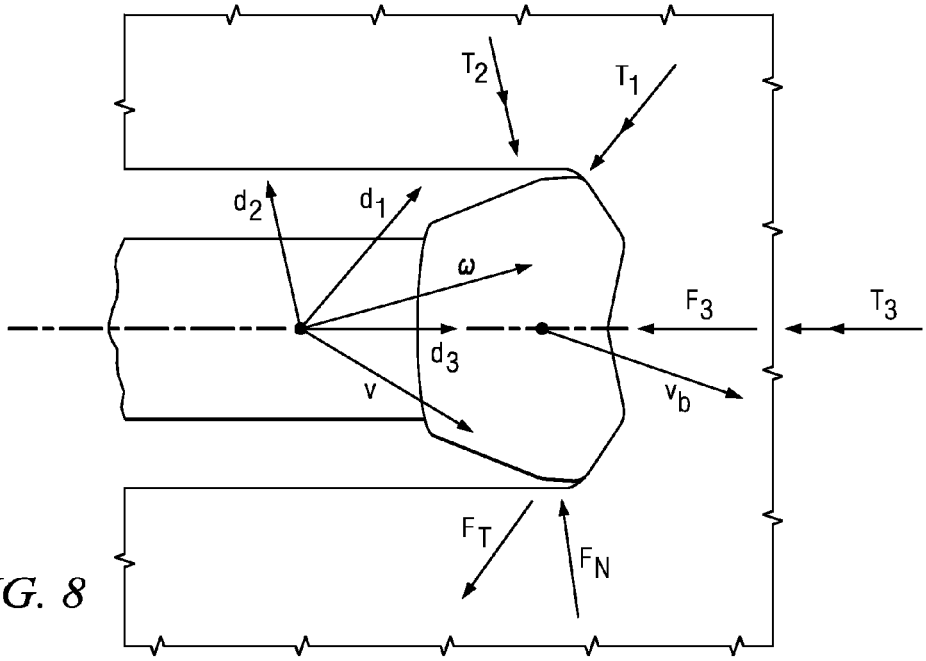
FIG. 8 is a diagram that schematically depicts the bit-rock interaction modeling to assist in explaining illustrative embodiments.

FIG. 8 is a diagram that schematically depicts the bit-rock interaction modeling to assist in explaining illustrative embodiments. The bit may, for example, be the drill bit 310 illustrated in FIG. 3. The modeling of the interaction of the drill bit with the rock or wall of the borehole is performed in creating a finite-difference model in these examples.

Two methods can be used, according to illustrative embodiments, to compute the depth of cut, which is the advance of bit into rock per revolution.

Method 1: the depth of cut (DoC) is computed using the instantaneous linear and angular velocity, such as The axial depth of cut, $DoC_3$, is obtained as $DoC_3 = 2\pi v_{b3}/\omega_3$ The lateral depth of cut, as $DoC_n = 2\pi v_{bn}/\omega_3$ And the parameter to represent the angle of rotation undergone by the bit axis per revolution of the bit, as $DoC_r = 2\pi\omega_n/\omega_3$ Method 2: the depth of cut is computed using the actual bit cutting advance per revolution, as The axial and lateral depth of cut as $$Doc = [R_{bit}(t) - R_{bit}(t - \Delta t_\theta)] \cdot N_{blades}$$

Where $\Delta t_\theta$ is the time used by the bit cutting blade to rotate to the position of another blade in front of it. $R_{bit}(t)$ is the cutting bit position vector, and $N_{blades}$ is the number of blades of the bit. Note that in the actual computation, some low pass filtering (e.g. spatial averaging) of the bit position may be needed to reduce the noise level. This can be considered as taking into account the finite angular span of the cutting elements in the bit.

The lateral angle of rotation per revolution can be computed as $$DoC_{r1}=d_2(t)gd_3(t-\Delta t_\theta)$$

$$DoC_{r2}=-d_1(t)gd_3(t-\Delta t_\theta)$$

Method 2 may be preferred inasmuch as Method 1 is based on the assumption that the bit is advancing and rotating in a steady state.

Figure 9:
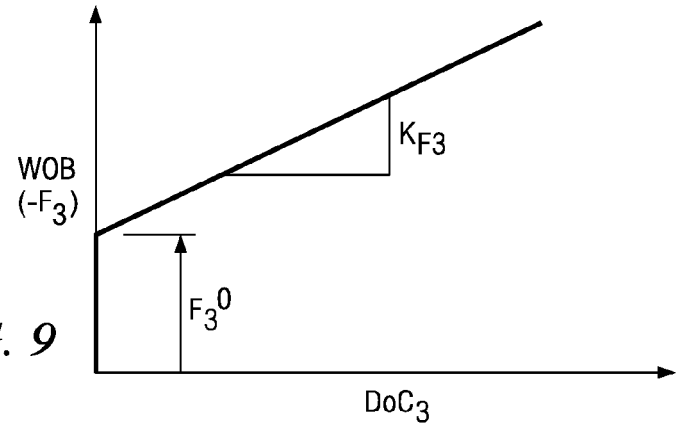
FIG. 9 is a graph that depicts WOB (Weight-on-Bit) versus $DoC_3$ (Depth of Cut) to assist in explaining illustrative embodiments.

After computing the different depths of cut using either method above, the reaction forces and torques experienced by the bit are computed as functions of those depths of cut. The axial reaction force, $F_3$, may be computed using an empirical relation between Weight on Bit (WOB), i.e., the force pushing the bit against the rock, and $DoC_3$. FIG. 9 is a graph that depicts WOB (Weight-on-Bit) versus $DoC_3$ (Depth of Cut) to assist in explaining illustrative embodiments.

As illustrated in FIG. 9, $F_3$, clearly is equal in magnitude and opposite to WOB. What has been found is that below a certain minimum value of WOB, there will be no cutting action. Above that value, the depth of cut will increase at a rate that is typically proportional to increases on the WOB. The initial threshold on the axial force, $F_3^0$, as well as the slope of the line, $K_{F3}$, illustrated in FIG. 9, are functions of the rock strength, and bit geometry.

It must be noted that even though in the present embodiment the expression represented in FIG. 9 is used, other functional dependencies between WOB and DoC are equally allowed if deemed necessary.

It is also important to recognize that the relationship illustrated in FIG. 9 assumes that the bit is turning in the "intended drilling direction." If by any chance, due to transient effects such as extreme stick-slip vibrations, the bit rotation is in the opposite direction, the relationship will not apply. It is assumed that the relation in this case is qualitative similar, although with values for the threshold, $F_3^0$, and slope, $K_{F3}$, typically much larger. This is because the bit will be less efficient at cutting in that direction. It is also assumed that the coefficients for "reverse drilling" are related to the original ones through a characteristic bit constant (Bit Reverse Coefficient, BRC>1).

Similar to the axial reaction force opposing the axial movement of the bit, there is also an axial reaction torque opposing the axial rotation of the bit as it cuts the rock. In fact, if it is assumed that the properties of the rock around the bit are uniform, then the axial reaction torque is computed using a similar method as the axial force. Once again, that relation assumes that the bit is turning in the intended direction. A similar linear relation can be expected under reverse bit rotation.

Figure 10:
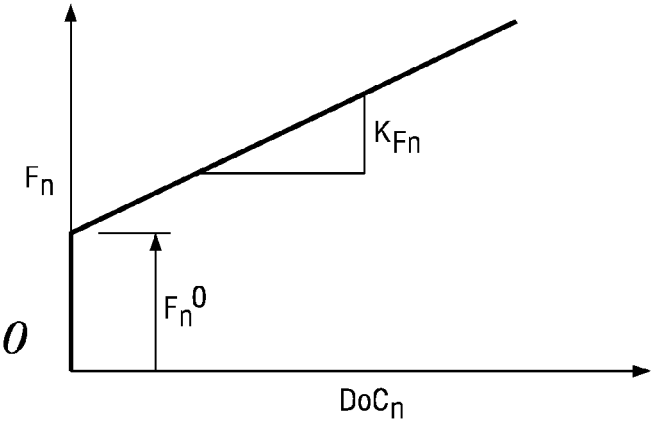
FIG. 10 is a graph that depicts lateral force $F_n$ versus $DoC_n$ to assist in explaining illustrative embodiments.

Similar to the reaction force opposing axial movement of the bit, there is also a reaction force opposing any lateral movement. The nature of the physical relationship between that reaction force and the lateral depth of cut, $DoC_n$, is typically of a similar nature to that along the axial direction, as illustrated in FIG. 10. In particular, FIG. 10 is a graph that depicts the lateral reaction force $F_n$, versus $DoC_n$ to assist in explaining illustrative embodiments. Here again, the initial threshold on the radial force, as well as the slope of the line, $F_n^0$, as well as the slope of the line, $K_{Fn}$, are functions of the rock strength and bit geometry. It is important to keep in mind that the actual direction of that normal reaction force is opposite to the unit vector $n_v$, which points in the direction in which the bit is moving perpendicular to its current axis. Also again, it should be noted that similar but larger values for the threshold and slope will apply when the bit transiently turns in a reverse direction. The same coefficient, BRC, is used to estimate the reverse values from the nominal ones.

As the bit rotates cutting the rock, there will be tangential reaction forces acting on the bit at each cutter location. Summed over the entire bit, those forces will typically cancel out when the bit moves perfectly axially (except for naturally imbalanced bits as described further below). However, when the bit moves laterally away from its axis, in addition to the normal reaction force from the rock, which directly opposes that movement, there will, in general, be a net tangential reaction force on the bit which is due to the increased cutting action on the side of the bit moving laterally into the rock. That tangential force is typically given by, $$F_T=\mu_T F_n(n\times d_3)\mathrm{sign}(\omega_3)$$

Where $\mu_T$ is a parameter determined by the bit cutting profile (in some sense similar to a friction coefficient, with the difference that $\mu_T$ could actually be negative). The sign ($\omega_3$) function at the end is necessary to capture the reversal in direction of that tangential force when the bit transiently turns in a reverse direction. μT is usually referred to as the tangent of the "walking" angle of the bit. This walking angle is the angle between the direction of the net lateral force applied on the bit from the rest of the BHA, and the lateral direction in which the bit actually moves as the drilling progresses.

Figure 11:
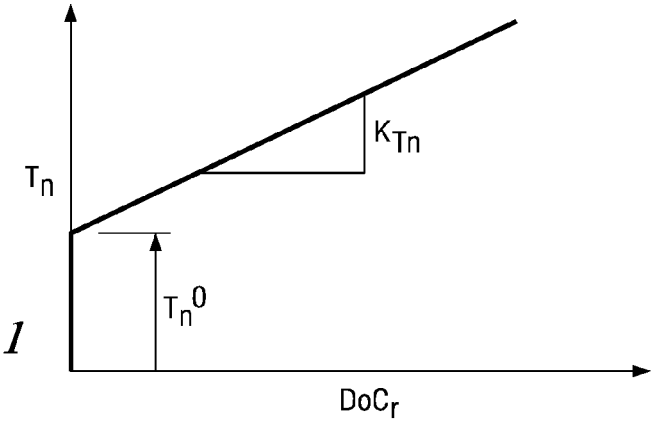
FIG. 11 is a graph that depicts angle of rotation of the bit axis versus reaction torque to assist in explaining illustrative embodiments.

The parameter $DoC_r$, which represents the angle of rotation undergone by the bit axis per revolution of the bit, was previously defined. If the bit has a spherical outer cutting surface, there will not be appreciable reaction torque from the rock trying to oppose that rotation. A non-spherical bit, however, will experience a reaction torque. Unfortunately, there is no experimental data on this aspect of the drilling process (That reaction torque is in general ignored). Here, it is assumed that the relationship between the normal reaction torque and $DoC_r$ is of a similar nature as that of the axial reaction torque to the axial depth of cut $DoC_3$. FIG. 11 is a graph that depicts angle of rotation versus reaction torque to assist in explaining illustrative embodiments.

One way to interpret that relation is to state that the bit axis will not experience any lateral rotations until the lateral torque imposed on it from the rest of the BHA is larger than a minimal threshold value, $T_n^0$. After that, the rate of lateral rotation of the bit axis per axial revolution of the bit will be proportional to the amount of lateral torque in excess of that threshold value. The reaction torque from the rock will be in a direction opposite to the lateral rotation of the bit axis. That is:

$$T_n=-T_n n_\omega$$

where $n_\omega$ is the unit vector in the direction of rotation of the bit axis.

In addition to that normal reaction torque which opposes the direction of rotation of the bit axis, there is a second reaction torque which is perpendicular to that direction of rotation. This "tangential" reaction torque (named that way because of its similarity to the net tangential force experienced by the bit as it moves laterally into the rock) is given by the expression:

$$T_T=\mu_r T_n(n_\omega\times d_3)\mathrm{sign}(\omega_3)$$

Where $\mu_r$ is a parameter determined by the bit cutting profile. The sign(ω3) function at the end is necessary to capture the reversal in direction of that tangential torque when the bit transiently turns in a reverse direction.

$$F_{1,imbalance}=K_{13}F_3$$

$$T_{imbalance}=r_b\times F_{1,imbalance}$$

Where $K_{13}$ is the bit imbalance coefficient (typically represented as a percentage of the WOB), and $r_b$ is the vector from the center of mass of the BHA segment including the bit to the center of the bit cutting structure.

It is understood that even though the present embodiment uses the above expressions for reaction forces and torques, the modeling tool is not limited to those expressions, in that other alternative procedures can be used to determine the reaction forces and torques as the drilling simulation progresses. For instance, one could use a full detailed model of the bit cutting structure that computes forces experienced by each individual cutting element as it cuts the rock, and assembles all the forces into a net pair of force and torque vectors acting at the center of the bit cutting structure. However, the procedure described above captures most of the relevant dynamic nature of the bit rock interaction while being much simpler to compute (less computationally intensive.)

Figure 12:
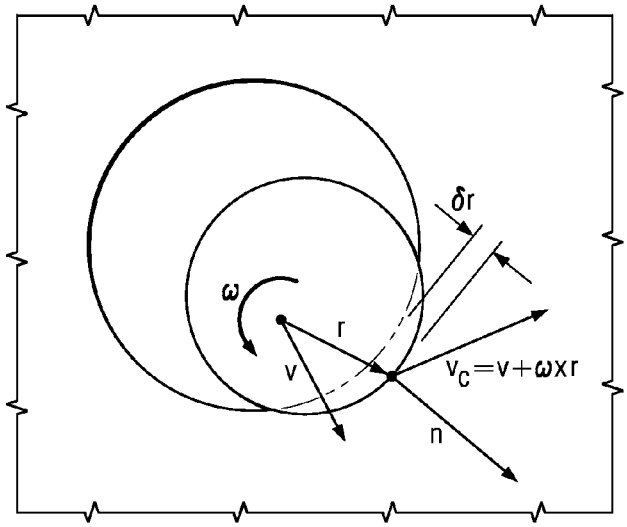
FIG. 12 is a diagram that schematically illustrates a collision site between a drilling tool and a wall of a wellbore to assist in explaining illustrative embodiments.
Figure 13:
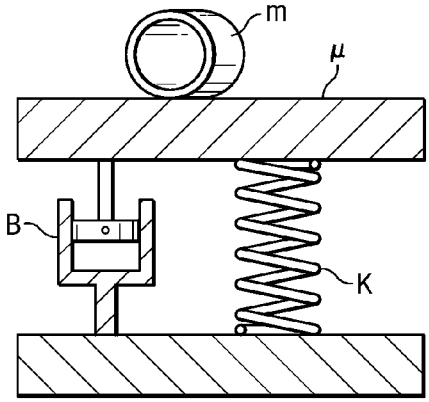
FIG. 13 is a diagram that schematically illustrates visco-elastic contact of a drilling tool and a wall of a wellbore to assist in explaining illustrative embodiments.

In accordance with illustrative embodiments, collisions are modeled as being visco-elastic. FIG. 12 is a diagram that schematically illustrates a collision site between a drilling tool and a wall of a wellbore to assist in explaining illustrative embodiments, and FIG. 13 is a diagram that schematically illustrates visco-elastic contact of a drilling tool and a wall of a wellbore to assist in explaining illustrative embodiments.

For a depth of wall penetration of δr and tool velocity $\dot{v}_c$ at the collision site, as illustrated in FIG. 12, the radially-directed force is:

$$F_{ve} = -K\delta r\vec{n} - B(\vec{v}_c \cdot \vec{n})\vec{n}$$

K is a stiffness constant to characterize the elastic interaction between the tool and borehole wall, and B is a visco-elastic damping coefficient. This visco-elastic damping coefficient is related to the mass of the tool section, the stiffness parameter K, and the coefficient of restitution ϵ by:
ln $$\varepsilon = \frac{-\pi B}{\sqrt{4Km - B^2}}$$

The elastic interaction is modeled via a Hertzian contact analysis. This analysis considers the effect of the geometry and elastic properties of both the tool and the borehole. The area of contact is, in this formulation, dependent upon the depth of penetration (as well as the geometry and elastic properties). As a result of this, the elastic force is a non-linear function of the depth of penetration. In Hertzian contact between two solid cylinders of radius and elastic properties $R_1$, $R_2$, $E_1$, $E_2$, $v_1$, and $v_2$, the half-width b of the contact area is calculated by:

$$b = \left(\frac{4F}{L}\left(\frac{1-v_1^2}{\pi E_1} + \frac{1-v_2^2}{\pi E_2}\right) \Big/ \left(\frac{1}{R_1} + \frac{1}{R_2}\right)\right)^{1/2}$$

Here F is the elastic load and L is the length of the contact area. The depth of penetration is calculated by:

$$\delta r = \frac{F}{L}\left(\frac{1-v_1^2}{\pi E_1} + \frac{1-v_2^2}{\pi E_2}\right)\left[\frac{2}{3} + \ln\left(\frac{2|R_1|}{b}\right) + \ln\left(\frac{2|R_2|}{b}\right)\right]$$

One additional aspect to the mechanics of the tool-borehole interaction is the structural compliance of the tool itself under compressive loading. This loading situation is depicted in FIG. 13.

In this loading situation, the tool will deform due to the applied load, resulting in a decrease in tool diameter along the direction of the contact (and a corresponding increase in diameter in the orthogonal direction. In other words, the cross section transiently becomes elliptical.). The change in tool diameter along the direction of contact is:

$$\Delta D = \frac{-12FR^3(1-v^2)}{ELt^3}\left(\frac{\pi k_1}{4} - \frac{2k_2^2}{\pi}\right)$$

In the above equation, R is the average of the inner and outer radius of the cylindrical tool, t, the wall thickness of the tool, and $k_1$, $k_2$ are defined by:

$$k_1 = 1-\alpha+\beta,\ k_2 = 1-\alpha$$

This change in diameter is generally a bending dominated deformation. However, for thick cylinders, hoop and shear stresses may play a significant role; α and β are parameters that account for hoop and shear stresses, respectively. These are defined by:

$$\alpha = \frac{h}{R},\ \beta = \frac{12h(1+v)}{5R}$$

h is the positive distance measured radially inward from the centroidal axis of the cross-section to the neutral axis of pure bending. h is calculated by:

$$h = R - t\Big/\ln\left[\left(R + \frac{t}{2}\right)\Big/\left(R - \frac{t}{2}\right)\right]$$

To account for the compliance of the tool b can be divided into a Hertzian component ($\delta r_1$) and a structural compliance component ($\delta r_2$):

$$\delta r = \delta r_1 + \delta r_2$$

The elastic portion of the visco-elastic force is calculated via the following equation:

$$\delta r = \frac{F}{L}\left(\frac{1-v_1^2}{\pi E_1} + \frac{1-v_2^2}{\pi E_2}\right)\left[\frac{2}{3} + \ln\left(\frac{2|R_1|}{b}\right) + \ln\left(\frac{2|R_2|}{b}\right)\right] + \frac{6FR^3(1-v^2)}{ELt^3}\left(\frac{\pi k_1}{4} - \frac{2k_2^2}{\pi}\right)$$

This equation must be solved iteratively in order to find the elastic load F for a given depth of penetration δr (the half-width b is a function of F). This is solved via Newton's Method.

The manner by which the visco-elastic damping is calculated in conjunction with both the Hertzian contact and tool structural compliance will now be described. Once the above equation is solved for the elastic force F, the effective stiffness $K_{eff}$ is calculated as:

$$K_{eff} = \frac{F}{\delta r}$$

Since the Hertzian contact force is nonlinearly related to the penetration depth δr, the effective stiffness $K_{eff}$ will be a function of δr.

In order to calculate the effective visco-elastic coefficient, the colliding segment routine takes in a coefficient of restitution (ϵ) as input. The visco-elastic coefficient is then calculated at a given penetration depth δr by inverting the above equation, using $K_{eff}$ as the stiffness quantity:

$$B_{eff} = \left(\frac{4K_{eff}m(\ln\varepsilon)^2}{\pi^2 + (\ln\varepsilon)^2}\right)^{1/2}$$

A simulation engine of the BHA/drillstring dynamic simulation according to illustrative embodiments may be implemented using C++ based on object-oriented design, with fine tuning of optimization for best performance.

The software application can be used in four main areas:

1. Product development. The software can be used on downhole tool design to understand the shock, stress and vibration environment the tool will endure in actual service, to help in understanding how and why tool failures occur, and to lead to better design practices and methodologies.
2. Well planning. The software can allow one to explore the effects of BHA design, including stabilizers and reamer placement. It will help in clarifying the interaction between the BHA design and the desired trajectory, and will enable the recommendation of drilling parameters to avoid potentially damaging behavior.
3. Directional drilling execution. While drilling, the driller can use the application to predict the effect of changing drilling parameters, or to anticipate changes in dynamic behavior when a formation change is expected.
4. Client education and communication. Such a tool allows easy visualization of the different types of vibration and the effects of changing parameters or formations. This will allow the drilling team to understand the consequences of decisions made during planning and execution. Another use can be in post-mortem analysis when a failure has occurred. In such a situation, the actual conditions can be modeled to help determine the root cause and lead to a faster and more accurate lessons learned feedback loop.

Figure 14:
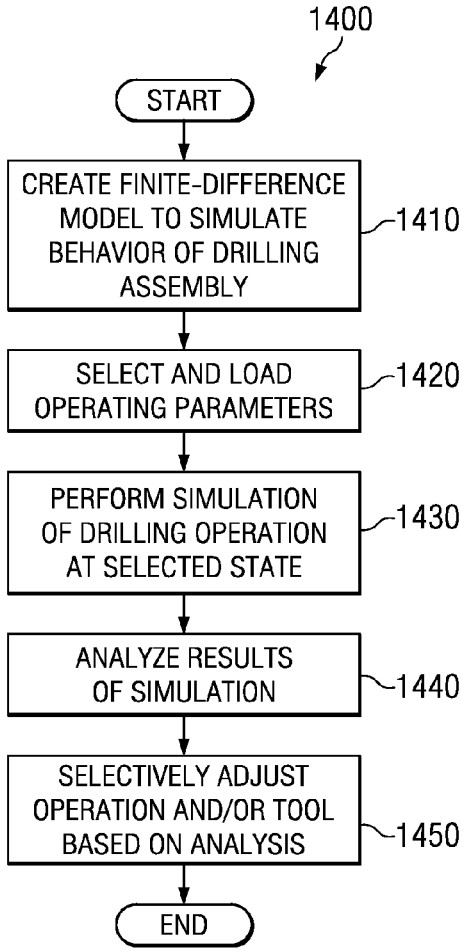
FIG. 14 is a flowchart that illustrates a method for performing a drilling operation for an oil field according to an illustrative embodiment.

FIG. 14 is a flowchart that illustrates a method for performing a drilling operation for an oil field according to an illustrative embodiment. The method illustrated in FIG. 14 may be implemented in a data processing system, such as modeling tool 408 in FIG. 4. This method may be used to simulate drilling operations for a particular well site. The results of the simulation may be used to make decisions with respect to drilling operations at the well site. Alternatively, the method may be used to test designs of drilling equipment, such as a drilling assembly. The method is generally designated by reference number 1400, and begins by creating a finite-difference model to simulate behavior of a drilling assembly used to drill a wellbore in the drilling operation (Step 1410).

This finite-difference model may be created in step 1410 specifying input objects, such as BHA, well trajectory/survey, wellbore geometry, rock properties along the wellbore, bit, bit-rock interaction properties, and the like. In particular, a BHA can be loaded from Drilling Office or similar product with BHA editing capabilities or from data in a database, file, catalog, or be manually entered, then meshed internally. The BHA in these examples is implemented in a finite-difference model. Trajectory can be loaded either from a survey or plan. Other inputs include loading rock properties, such as the rock elastic properties (Young's module, Poisson ratio), the coefficient of friction (dynamic and static), and the coefficient of restitution corresponding to the collision interaction. Bit/rock interaction properties may also be loaded. All of this data is used in step 1410 to generate a finite-difference model to simulate operation of a drilling assembly and its interaction with walls in a wellbore.

Operating parameters for the simulation are selected and loaded (Step 1420). A simulation of the drilling operation is then performed at a selected state of the drilling operation (Step 1430). In particular, a single point simulation is run in these examples. The simulation may be for a BHA at specific MD (ROP/RPM setting). The simulation may accelerate from a steady state to an operating point. The simulation may then be allowed to run for a period of time, such as a few seconds, to determine stability of the BHA. This simulation may be performed to determine whether changes should be made in the drilling operations for a well site. This simulation also may be performed on experimental designs for drill strings or components in the drill strings to determine whether changes are needed to the design to optimize performance for different parameters. These parameters for optimization may be, for example, the rate at which a wellbore is created or how long components in a drill string will last.

The simulation also may be performed for a drill string in a "stick-slip" scenario to simulate friction on pipes in the drill string. Dynamic plots may be obtained from these simulations to provide indications of vibration on the drilling assembly and other properties, such as RPM. These plots may be updated in real-time.

The results of the simulation are then analyzed (Step 1440). This analysis may, for example, involve post processing and creation of plots involving a one dimensional BHA Plot in color with 3 dimensional deflection. With this type of plot, a user may be able to select plots that illustrate different parameters, such as axial force/stress; fatigue; lateral acceleration; BHA-wellbore collision force; whirl factor/indicator; circular plot with bit, stab rotating; energy along BHA versus time/frequency; virtual shock counts on each element, with color to distinguish the level: >50 G yellow, >100 G Red; overall efficiency (energy transmitted at bit/energy in). The plots also may include three dimensional surface plots and color images to indicate the physical variable's propagation along BHA and time. Two dimensional x-y plots may be created for different physical variables at specific point changing with time. Also, energy spectrums at specific point in a specific time window may be provided for analysis.

In these examples, the handling of output data may include being able to select any physical variable and compose one to four of them together on screen. Also, the output may be in a form that allows animation of the BHA movement and other physical variables changing with time. A movie of the animations may be saved as well as embedding the movie in a report document.

With this information and analysis, the drilling operation and/or the drilling tool can then be selectively adjusted based on the analysis (Step 1450). Specifically, using the analysis, one can modify to get stability/efficiency for different parameters, such as the BHA, the drill bit, or drilling operation parameters. Also, the ROP may be optimized by analyzing BHA, the bit, and/or drilling operation parameters. These changes may be made to an actual drilling operation using a drill string to form a wellbore in a formation. Alternatively, the results of the simulation may be used to alter designs for components, such as a BHA, a drill bit, or other components. Further, the results may be used to identify optimal operating parameters.

Figure 15:
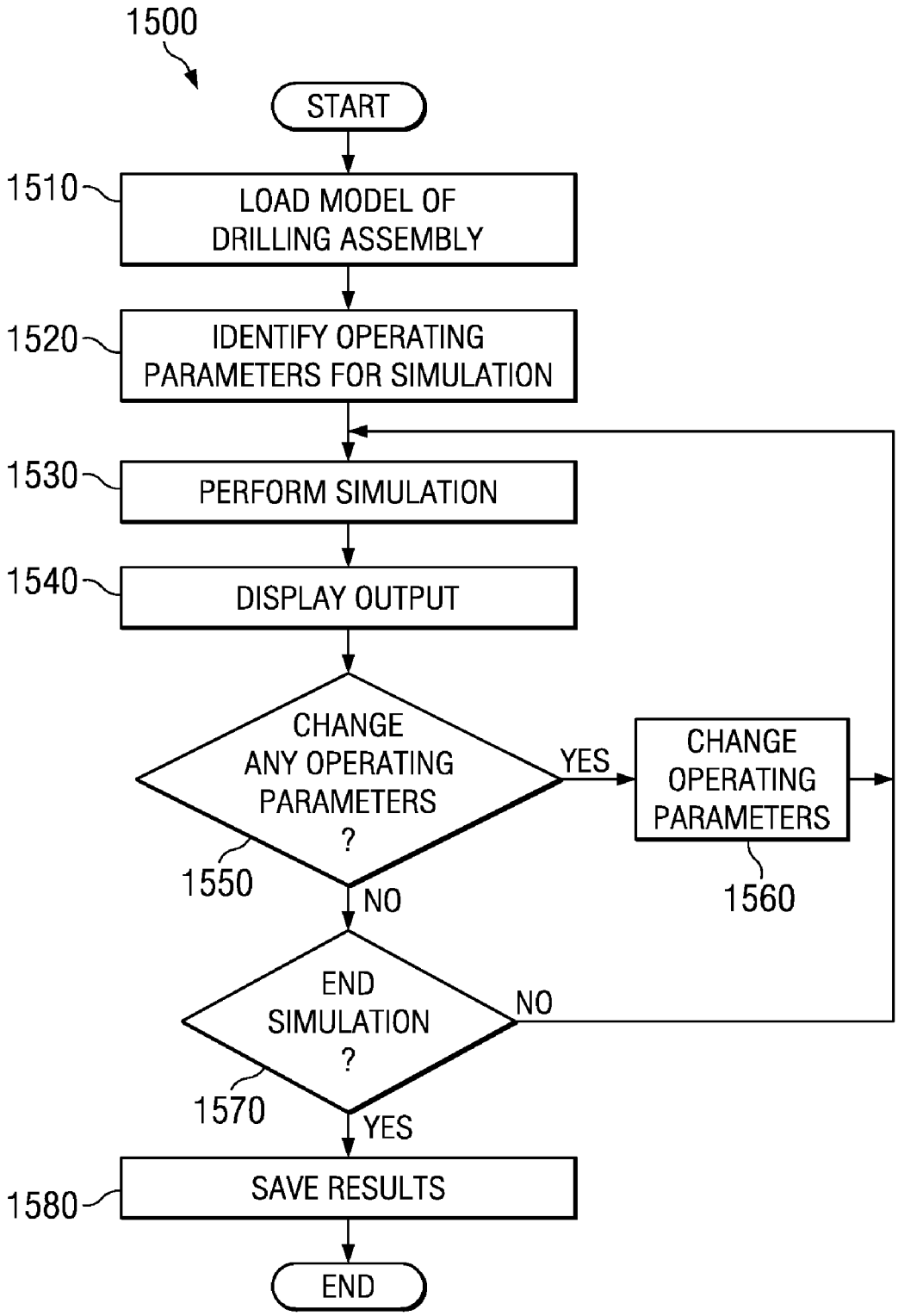
FIG. 15 is a flowchart of a simulation for a drilling assembly.

Next, FIG. 15 is a flowchart of a simulation for a drilling assembly in accordance with an illustrative embodiment of the present invention. The method illustrated in FIG. 15 is a more detailed description of Step 1430 in FIG. 14.

The method is generally designated by reference number 1500 and begins by loading the model of the drilling assembly (Step 1510). In these examples, the model is a finite-difference model of the drilling assembly. The drilling assembly may be for example, the entire drill string or just the BHA. Thereafter, the operating parameters are identified for the simulation (Step 1520). These operating parameters are parameters used to simulate the operation of the drilling assembly in a wellbore. The parameters may include, for example, the revolutions per minute of the drilling assembly, the weight placed on the bit, and the amount of drilling fluid used. The parameters also may include state changes. For example, the parameters may specify accelerating rotations from a first speed to a second speed, and to maintain the second speed for some selected period of time. The parameters may then specify another state that occurs after the selected period of time, such as slowing the speed of the drilling assembly.

Next, the simulation is performed using the selected model and operating parameters (Step 1530). The output from the simulation is processed and presented (Step 1540). This step is an optional step that provides a visual presentation of results from the simulation as they occur. The presentation may be for example, graphs, plots, raw data, or animations. The output may provide, for example, information about oscillations and vibrations in the drilling assembly. The other information may include, for example, wear on the drilling assembly or a rate at which a wellbore is created. Examples of these types of presentations are described and shown in more detail in FIGS. 16-21 below.

Next, a determination is made as to whether any operating parameters should change (Step 1550). Operating parameters may change as the simulation progresses. These changes may be specified as part of the initial operating parameters identified in Step 1520. Alternatively, a user input may be received in Step 1550 to change the parameters. The changing parameters may be to change a state of the drilling assembly, such as changing the speed at which the drilling assembly rotates. The change also may be, for example, changing the weight applied at the bit.

If one of more of the operating parameters should change, these operating parameters are changed (Step 1560) and the process then returns to step 1530 to continue performing the simulation with the changes to the operating parameters. In step 1550, if no changes are to occur for any of the operating parameters, a determination is made as to whether the simulation is to end (Step 1570). If the simulation is not to end, the method returns to step 1530 to continue performing the simulation on the drilling assembly.

Otherwise, the method saves the results of the simulation (Step 1580) and terminates. The results may take various forms. The raw data output by the simulation of the drilling assembly may be saved. Also, any real time animations, movies, plots or other output generated in Step 1540 also may be saved. These results may be used to implement changes or to plan drilling operations at a well site. These results also may be used to change designs for drilling assemblies, such as a BHA or bit.

Figure 16:
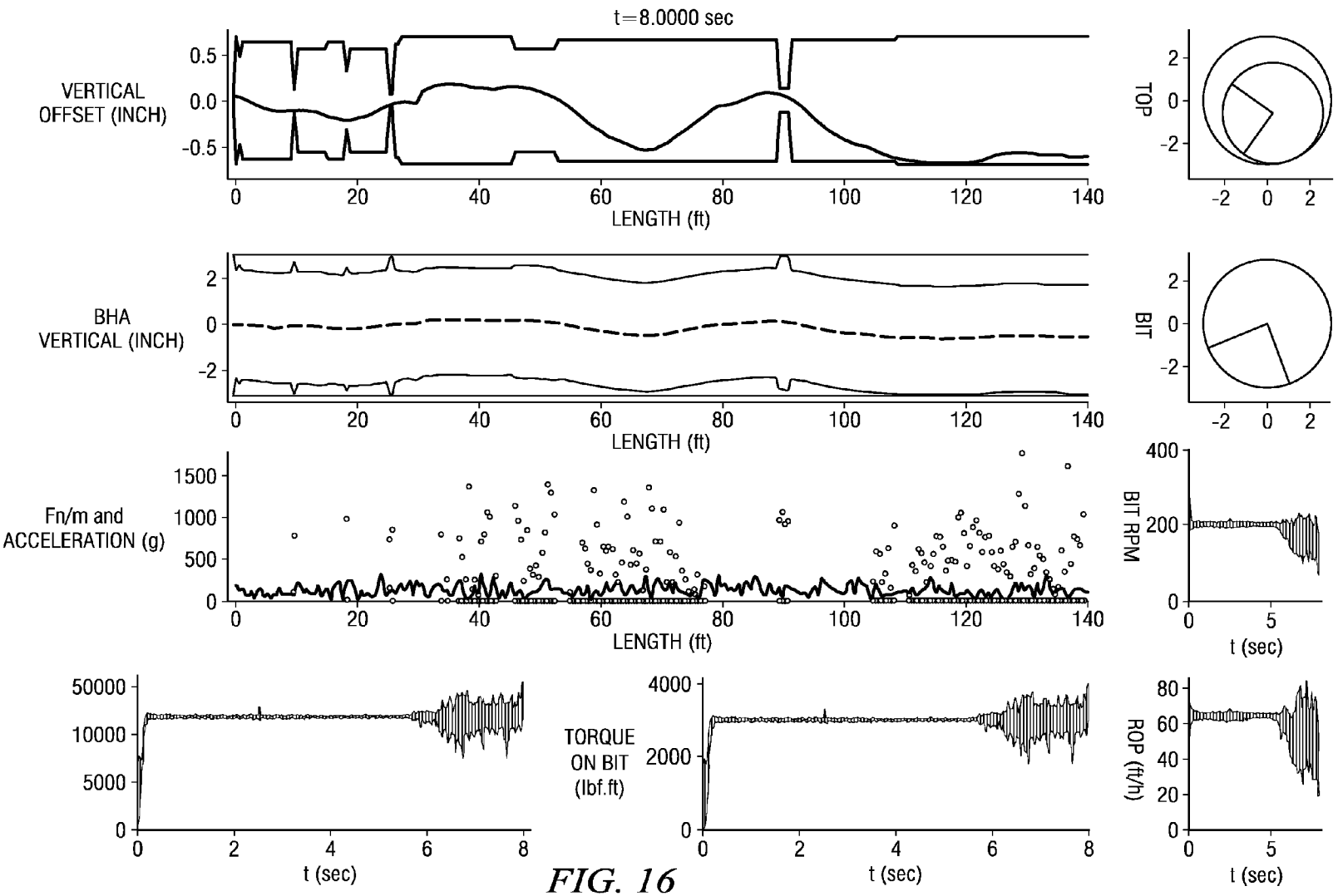
FIGS. 16-21 depict plots generated from some simulations performed according to illustrative embodiments.

Next, FIGS. 16-21 depict plots generated from some simulations performed according to illustrative embodiments. First, FIG. 16 depicts a snap shot of a 2-D animation of the BHA vibration in a horizontal well. The left first plot (a) indicates the displacement of the BHA centerline in the vertical direction. The left second plot (b) is the BHA displacement in the vertical direction. The left third plot (c) shows the instantaneous BHA-wellbore collision force per unit mass in units of gravity as well as its maximum recorded value as the simulation progresses along the BHA. The right top two plots (e) and (f) show the rotation of bit and top in animation. The bottom right two plots (g) and (h) show the WOB, torque on bit, ROP and rpm changing with time.

Figure 17:
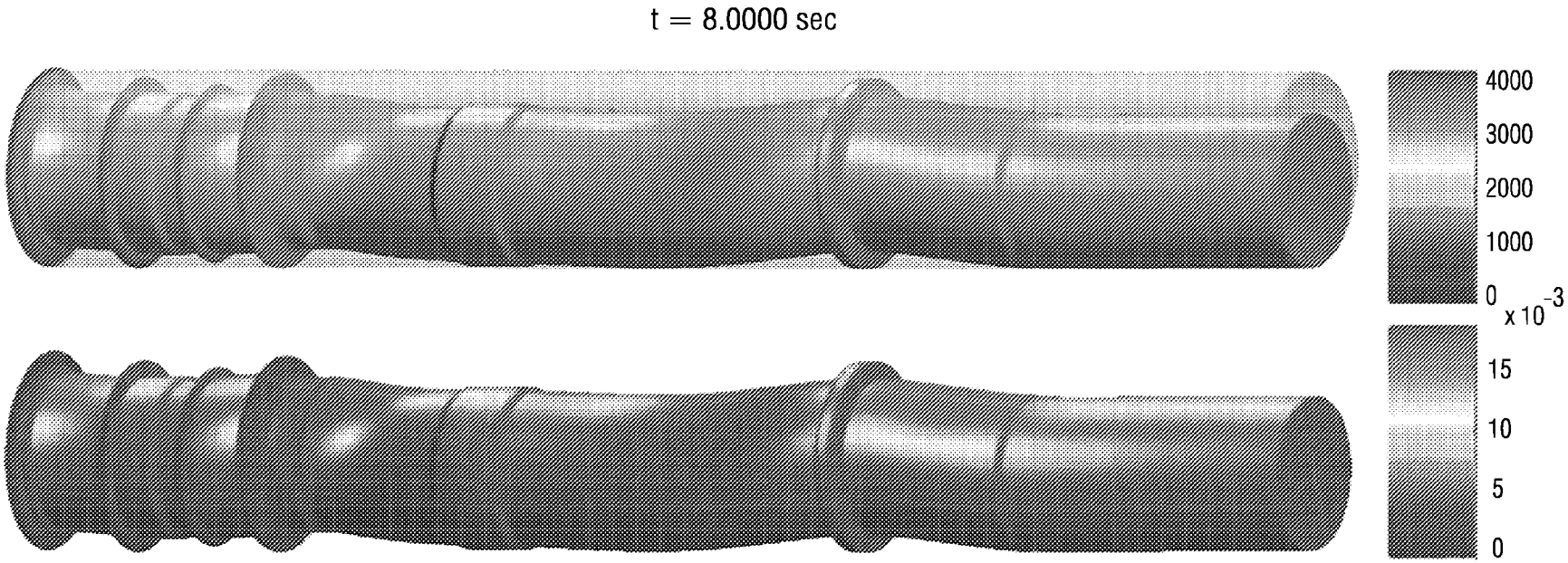

FIG. 17 depicts a snapshot of the BHA 3-D animation representing different properties (top plot, the torsional torque; bottom plot, the axial velocity).

Figure 18:
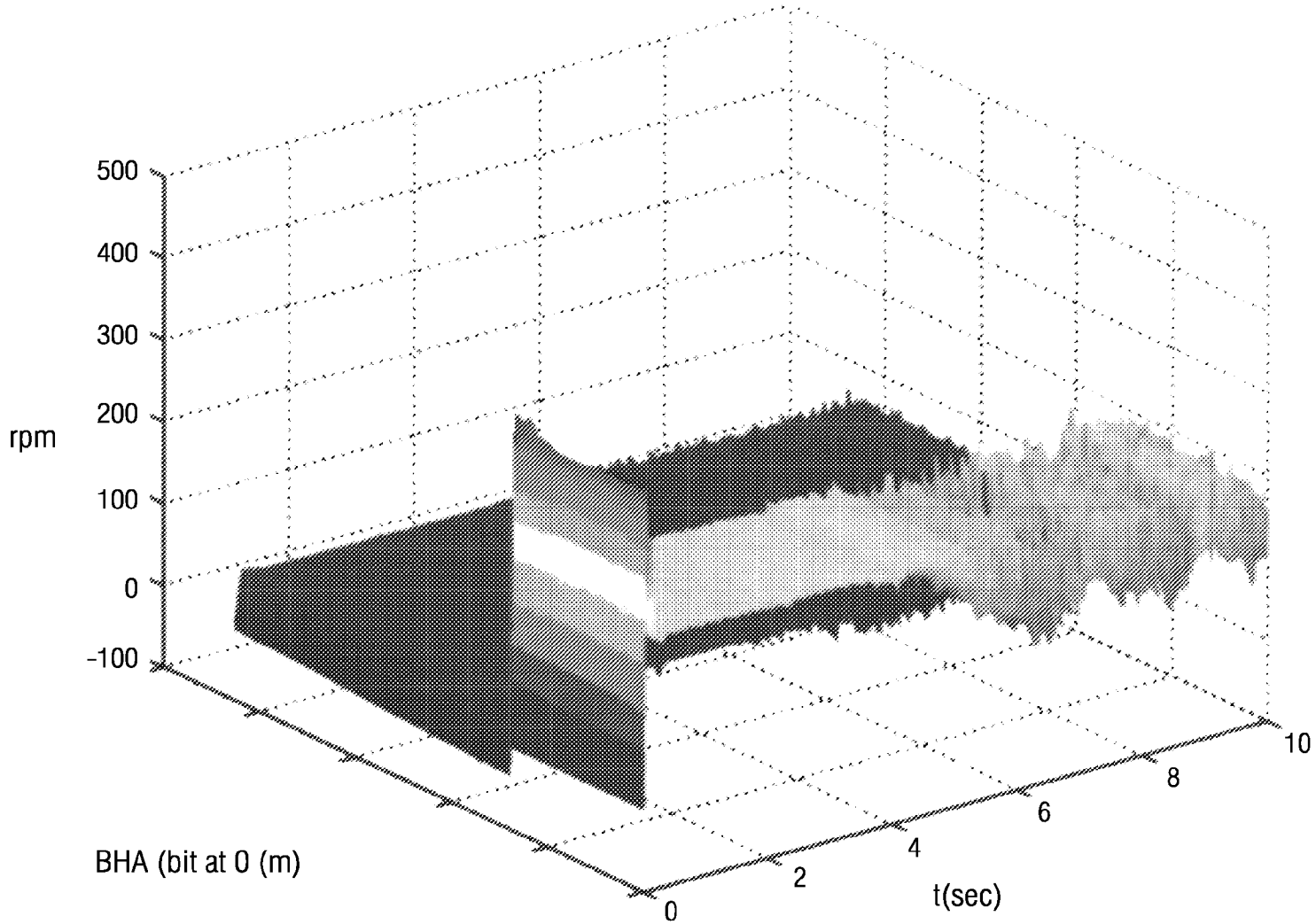

FIG. 18 depicts a surface plot of the rpm along BHA and time. In this example, there is a downhole motor in BHA thus the lower part of BHA rotates faster than the upper part.

Figure 19:
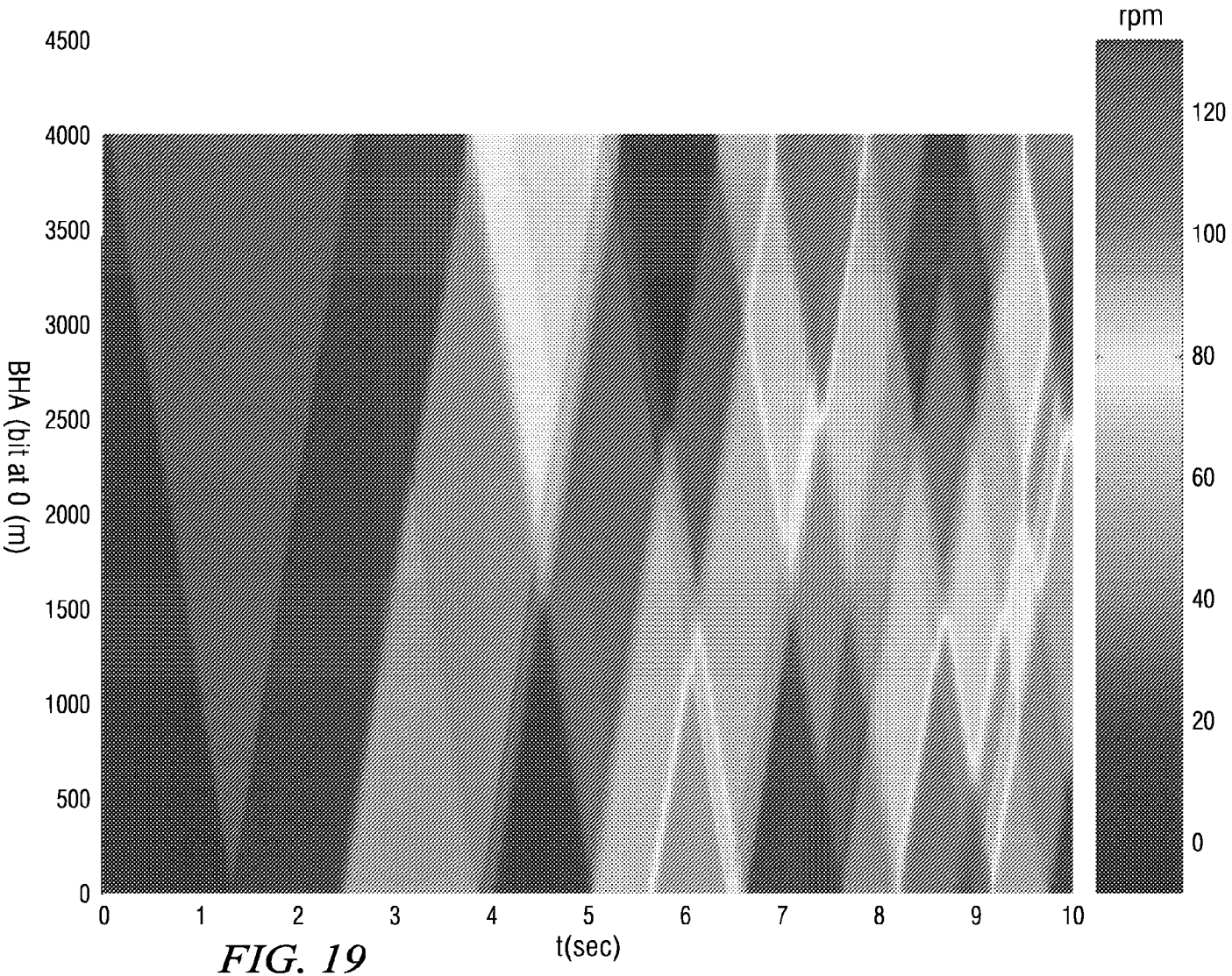

FIG. 19 depicts an image of RPM along BHA and time. This is an example for a simple BHA with very long collar (about 4000 m). The image indicates the torsional waves' propagating and reflecting from the top (surface) and bottom (bit) of the tool.

Figure 20:
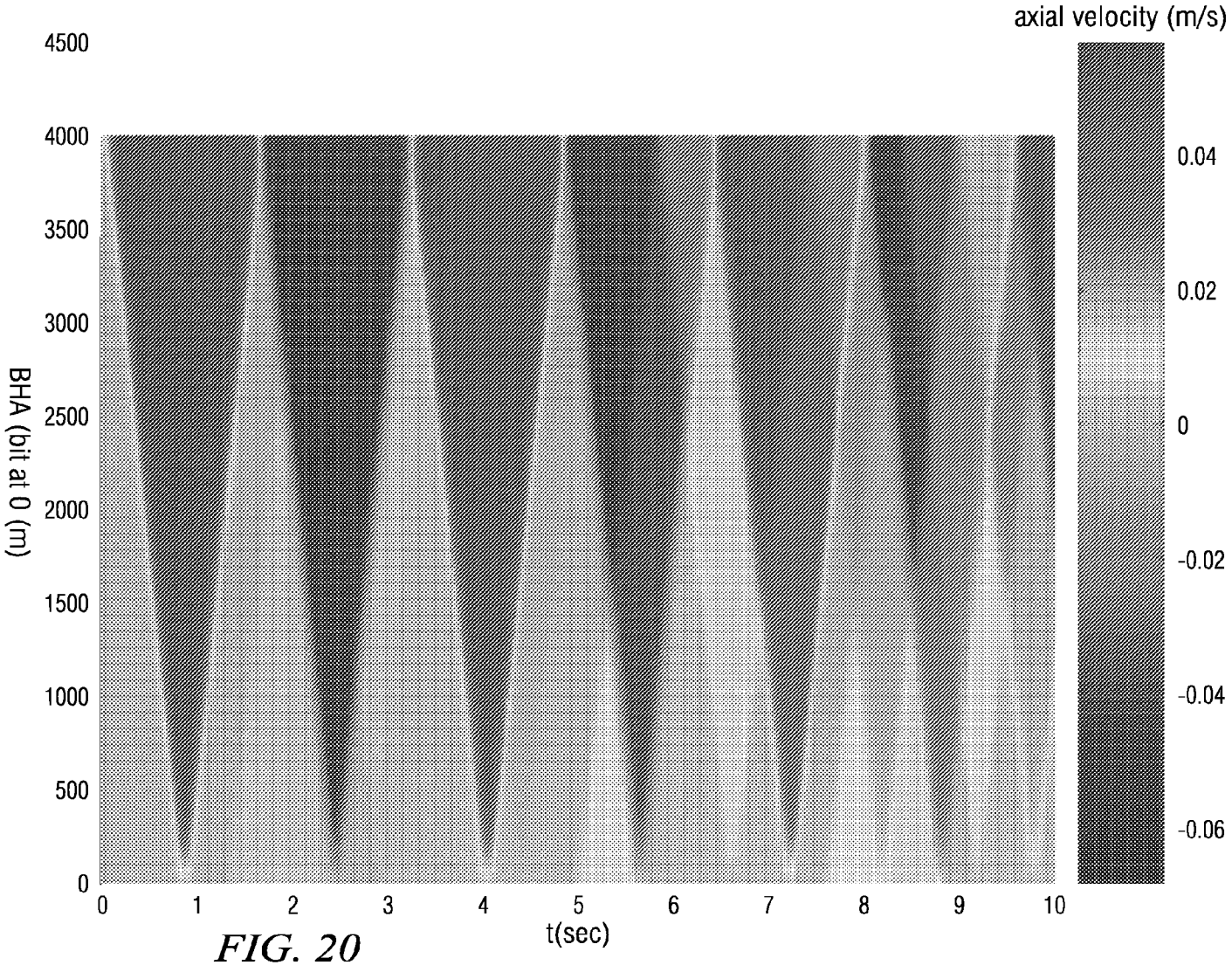

FIG. 20 depicts an image of axial velocity along BHA and time. This is an example for a simple BHA with very long collar (about 4000 m). The image indicates the axial (extensional) waves' propagating and reflecting from the top (surface) and bottom (bit) of the tool.

Figure 21:
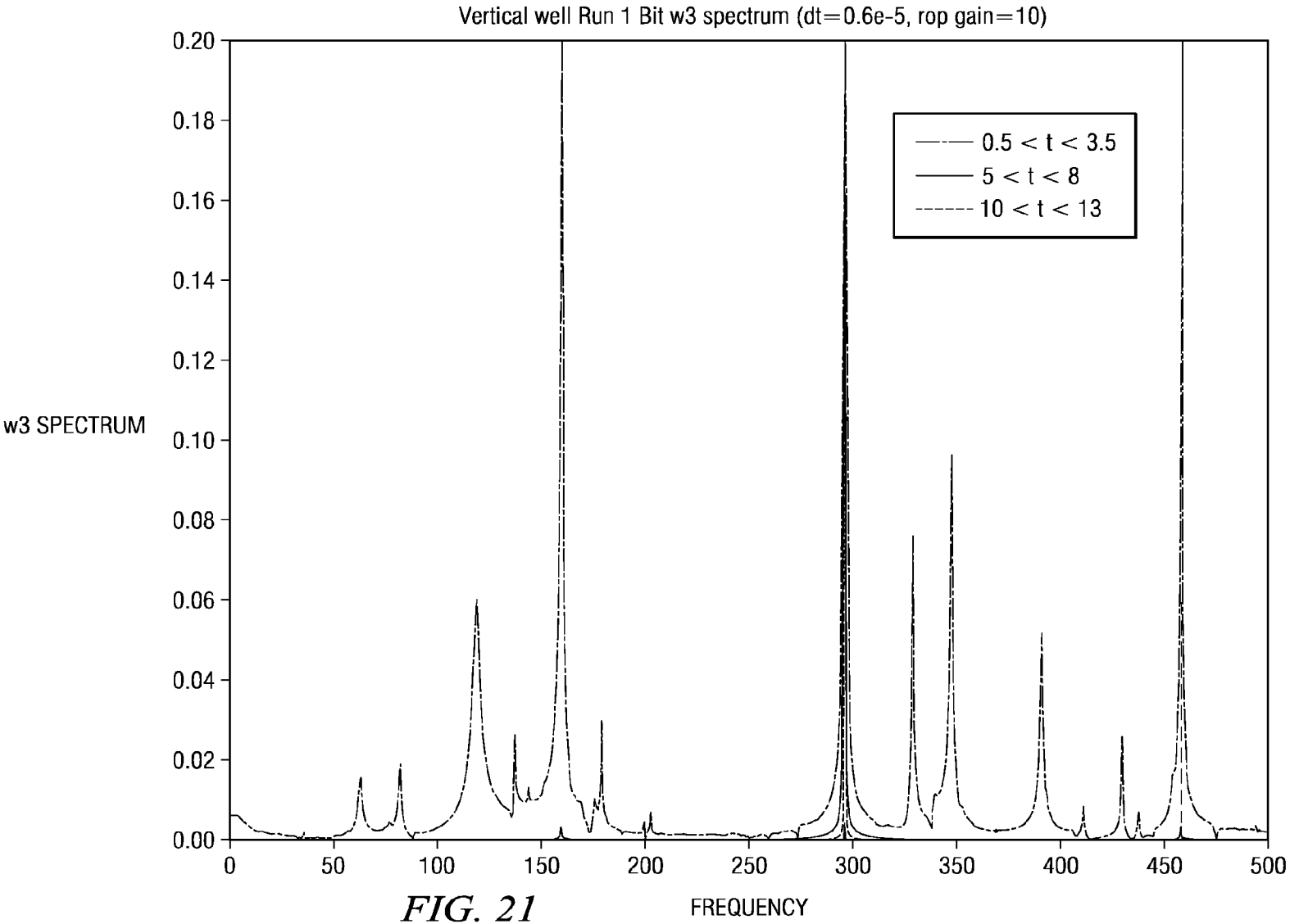

FIG. 21 depicts the energy spectrum of the bit rotation at different time periods.

Thus, the different illustrative embodiments provide a method, apparatus, and computer usable program code for modeling drilling operations in a manner that allows for decisions on drilling operations to be made at a well site. More specifically, the model is used to simulate behavior of the drilling assembly during drilling of a wellbore in the drilling operation within a selected tolerance when compared to using the drilling assembly to actually drill the wellbore in the drilling operation.

The different embodiments also provide an ability to test designs for equipment, such as, for example, a drilling assembly. The different embodiments utilize finite-difference models of the drilling assembly in the simulations. These models includes the interaction of a drill bit of the drilling assembly with rock along the wellbore using a formulation in which reaction forces and torque are dependent on depth of cut, rock strength, and drill bit geometry.

Additionally, the models allow the simulation to be changed from one state to another state in a manner that identifies changes in parameters, such as vibrations in the different components and how the vibrations affect the components in the drilling assembly.

It will be understood from the foregoing description that various modifications and changes may be made in the preferred and alternative embodiment of the invention without departing from its true spirit. For example, the method may be performed in a different sequence, and the components provided may be integrated or separate. As another example, although the illustrative embodiments use a finite different model for the drill string, other types of models may be used. For example, a finite element model of a drill string may be used in place of or in conjunction with the finite-difference model.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method for performing a drilling operation for an oil field, the oil field having a subterranean formation with geological structures and reservoirs therein, comprising:

creating a finite-difference model to simulate behavior of a drilling assembly used to drill a wellbore in the drilling operation by:

modeling the wellbore as a visco-elastic boundary with friction; and modeling interaction of a drill bit of the drilling assembly with rock along the wellbore using structural compliance of the tool under compressive loading and a modified Hertzian contact formulation in which contact area, reaction forces, and torque are non-linearly dependent on depth of cut, rock strength, and drill bit geometry, wherein the depth of cut is calculated using actual bit cutting advance per revolution;

performing a simulation of the drilling operation using the finite-difference model;

analyzing a result of the simulation to generate an analysis; and generating, using a computer processor, a modified drilling operation by selectively modifying the drilling operation within the finite-difference model based on the analysis.

2. A method for claim 1, further comprising:

implementing the modified drilling operation at a wellsite of the oil field.

3. A method for claim 1, further comprising:

selectively modifying the drilling assembly based on the analysis.

4. The method of claim 1, wherein the simulation of the drilling operation using the finite-difference model is performed at a selected state of the drilling operation.

5. The method of claim 4, wherein performing the simulation of the drilling operation at the selected state of the drilling operation, comprises:

changing a state of the drilling assembly from a current state to the selected state.

6. The method of claim 5, wherein performing the simulation of the drilling operation at the selected state of the drilling operation, further comprises:

operating the drilling assembly at the selected state for a predetermined period of time to identify changes in the drilling assembly at the selected state.

7. The method of claim 1, wherein performing the simulation of the drilling operation using the finite-difference model, comprises:

performing the simulation at a selected rate of penetration.

8. The method of claim 1, wherein the drilling assembly comprises a bottom hole assembly.

9. The method of claim 1, wherein the drilling assembly comprises a drill string.

10. The method of claim 1, wherein the actual bit cutting advance per revolution is based on an amount of time that a bit cutting blade of a plurality of bit cutting blades on the drill bit rotates to a position of an adjacent bit cutting blade on the drill bit.

11. A method of performing a drilling operation for an oil field, the oil field having a subterranean formation with geological structures and reservoirs therein, comprising:

creating a model to simulate behavior of a drilling assembly used to drill a wellbore in the drilling operation by:

modeling the wellbore as a visco-elastic boundary with friction; and modeling interaction of a drill bit of the drilling assembly with rock along the wellbore using structural compliance of the tool under compressive loading and a modified Hertzian contact formulation in which contact area, reaction forces, and torque are non-linearly dependent on depth of cut, rock strength, and drill bit geometry, wherein the depth of cut is calculated using actual bit cutting advance per revolution;

performing a simulation of the drilling operation with a set of different states using the model;

analyzing a result of the simulation to generate an analysis; and generating, using a computer processor, a modified drilling operation by selectively modifying, within the model, at least one of the drilling operation and the drilling assembly based on the analysis.

12. The method of claim 11, further comprising:

implementing the modified drilling operation at a wellsite of the oil field.

13. The method of claim 11, wherein performing the simulation of the drilling operation with the set of different states using the model, comprises:

changing a state of the drilling assembly from a current state to a selected state;

operating the drilling assembly at the selected state for a predetermined period of time; and determining a stability of the drilling assembly at the selected state.

14. The method of claim 11, wherein creating the model to simulate behavior of the drilling assembly used to drill the wellbore in the drilling operation, comprises:

creating a finite-difference model to simulate behavior of the drilling assembly while drilling the wellbore in the drilling operation.

15. The method of claim 13, further comprising:

dynamically modifying at least one parameter of the at least one of the drilling operation and the drilling assembly during operation of the drilling assembly at the selected state.

16. A method of performing a drilling operation for an oil field, the oil field having a subterranean formation with geological structures and reservoirs therein, comprising:

creating a model of a drilling assembly, wherein the model is used to simulate behavior of the drilling assembly during drilling of a wellbore in the drilling operation within a selected tolerance when compared to using the drilling assembly to actually drill the wellbore in the drilling operation, wherein creating a model includes:

modeling the borehole as a visco-elastic boundary with friction; and modeling interaction of a drill bit of the drilling assembly with rock along the wellbore using structural compliance of the tool under compressive loading and a modified Hertzian contact formulation in which contact area, reaction forces, and torques are non-linearly dependent on depth of cut, rock strength and drill bit geometry, wherein the depth of cut is calculated using actual bit cutting advance per revolution;

performing a simulation of the drilling operation using the model;

analyzing a result of the simulation to generate an analysis; and generating, using a computer processor, a modified drilling operation by selectively modifying, within the model, at least one of the drilling operation and the drilling assembly based on the analysis.

17. The method of claim 16, further comprising:

implementing a selectively modified drilling operation at a wellsite of the oil field.

18. The method of claim 16, wherein selectively modifying the at least one of the drilling operation and the drilling assembly based on the analysis includes:

modifying the model of the drilling assembly.

19. The method of claim 16, wherein the model comprises a finite-difference model.

20. The method of claim 16, wherein performing the simulation of the drilling operation using the model comprises:

performing the simulation of the drilling operation at a selected state of the drilling operation.

21. A non-transitory computer usable medium having computer usable program code for performing a drilling operation for an oil field, the oil field having a subterranean formation with geological structures and reservoirs therein, the computer usable program code when executed causing a computer processor to:

create a finite-difference model to simulate a drilling assembly drilling a wellbore in a drilling operation by:

modeling the wellbore as a visco-elastic boundary with friction; and modeling interaction of a drill bit of the drilling assembly with rock along the wellbore using structural compliance of the tool under compressive loading and a modified Hertzian contact formulation in which contact area, reaction forces, and torque are non-linearly dependent on depth of cut, rock strength, and drill bit geometry, wherein the depth of cut is calculated using actual bit cutting advance per revolution;

perform a simulation of the drilling operation using the finite-difference model;

analyze a result of the simulation to generate an analysis; and generate a modified drilling operation by selectively modifying the drilling operation within the finite-difference model based on the analysis.

22. The non-transitory computer usable medium of claim 21, wherein the simulation of the drilling operation using the finite-difference model is performed at a selected state of the drilling operation.

23. The non-transitory computer usable medium of claim 22, wherein the drilling assembly is changed from a current state to the selected state.

24. The non-transitory computer usable medium of claim 23, wherein the drilling assembly is operated at the selected state for a predetermined period of time to identify changes in the drilling assembly at the selected state.

25. A non-transitory computer usable medium having computer usable program code for performing a drilling operation for an oil field, the oil field having a subterranean formation with geological structures and reservoirs therein, the computer usable program code when executed causing a computer processor to:

create a model to simulate behavior of a drilling assembly used to drill a wellbore in the drilling operation by:

modeling the wellbore as a visco-elastic boundary with friction; and modeling interaction of a drill bit of the drilling assembly with rock along the wellbore using structural compliance of the tool under compressive loading and a modified Hertzian contact formulation in which contact area, reaction forces, and torque are non-linearly dependent on depth of cut, rock strength, and drill bit geometry, wherein the depth of cut is calculated using actual bit cutting advance per revolution;

perform a simulation of the drilling operation with a set of different states using the model;

analyze a result of the simulation to generate an analysis; and generate a modified drilling operation by selectively modifying, within the model, at least one of the drilling operation and the drilling assembly based on the analysis.

26. The non-transitory computer usable medium of claim 25, wherein the simulation of the drilling operation with a set of different states using the model is performed by:

changing the drilling assembly from a current state to a selected state;

operating the drilling assembly at the selected state for a predetermined period of time; and determining a stability of the drilling assembly at the selected state.

27. The non-transitory computer usable medium of claim 25, the computer usable program code further causing the computer processor to:

create a finite-difference model to simulate behavior of a drilling assembly while drilling the wellbore in the drilling operation.

28. The non-transitory computer usable medium of claim 26, the computer usable program code further causing the computer processor to:

dynamically modify at least one parameter of at least one of the drilling operation and the drilling assembly during operation of the drilling assembly at the selected state.

29. A system for performing a drilling operation for an oil field, the oil field having a subterranean formation with geological structures and reservoirs therein, comprising:

a computer processor;

a modeling unit executing on the computer processor to create a finite-difference model to simulate behavior of a drilling assembly used to drill a wellbore in the drilling operation by:

modeling the wellbore as a visco-elastic boundary with friction;

modeling interaction of a drill bit of the drilling assembly with rock along the wellbore using structural compliance of the tool under compressive loading and a modified Hertzian contact formulation in which contact area, reaction forces, and torque are non-linearly dependent on depth of cut, rock strength, and drill bit geometry, wherein the depth of cut is calculated using actual bit cutting advance per revolution; and generate a modified drilling operation by selectively modifying the drilling operation within the finite-difference model based on an analysis a simulation unit operatively connected to the modeling unit for performing a simulation of the drilling operation using the finite-difference model; and an analyzer operatively connected to the modeling unit for analyzing a result of the simulation to generate the analysis.

30. The system of claim 29, further comprising:

a mechanism operatively connected to the modeling unit and executing on the computer processor to implement the modified drilling operation.

* * * * *